US006066271A

United States Patent [19]

Hormadaly

[11] Patent Number: 6,066,271

[45] Date of Patent: May 23, 2000

[54] COBALT RUTHENATE THERMISTORS

[75] Inventor: Jacob Hormadaly, Omer, Israel

[73] Assignee: Ben Gurion University of the Negev, Israel

[21] Appl. No.: 08/923,957

[22] Filed: Sep. 5, 1997

[51] Int. Cl.[7] ..... H01B 1/14

[52] U.S. Cl. ..... 252/521.2

[58] Field of Search ..... 252/521.2, 519.51; 501/20, 21

[56] References Cited

U.S. PATENT DOCUMENTS

| | | | |
|---|---|---|---|
| 3,960,778 | 6/1976 | Bouchard et al. | 252/519 |
| 4,347,166 | 8/1982 | Tosaki et al. | 252/519 |
| 4,539,223 | 9/1985 | Hormadaly | 427/102 |
| 5,122,302 | 6/1992 | Hormadaly | 252/518 |
| 5,491,118 | 2/1996 | Hormadaly | 501/20 |

FOREIGN PATENT DOCUMENTS

02165447 A2 6/1990 Japan .

OTHER PUBLICATIONS

Mendonca et al "Studies of the Spinal Solid Solution $Co_2Ru_{1-x}Fe_xO_4$" J. Mater. Chem. (1994), 4(4) pp. 515–517.

Beck et al "Investigation of superconductivity and physical properties" of some spinel–, porouskite–and pyrochlove oxides Inst.Inorg.Chem/J. Less–Common Met. 1989, 147(2) 217–220.

Krutzsch et al., "Saurstoff—Spinelle Mit Ruthenium Und Iridium," Mat. Res. Bull., vol. 18, pp. 647–652, 1983 (with English Abstract).

Krutzsch et al., Investigations Concerning the Incorporation of Ti, Cr, Mn, Fe, Cu, Zn and Rh into the Co–Ru–Spinel Phase $Co_{2+x}Ru_{1-x}O_4$, Mat. Res. Bull., vol. 19, pp. 1659–1668, 1984 (English translation).

*Primary Examiner*—Mark Kopec

*Attorney, Agent, or Firm*—Lerner, David, Littenberg, Krumholz & Mentlik, LLP

[57] ABSTRACT

Composition of matter of cobalt ruthenate compounds and glass, wherein said compounds have the formula $Co_{3-x}Ru_{x-y}M_yO_4$ wherein: M is a metal selected from among Mn, Fe, Cu, Zn and Al; and x and y are numbers in the range between 0 and 2, inclusive, and thick film paste compositions comprising said compounds are provided. Novel cobalt ruthenate compounds, process for preparing such compounds and uses thereof are also provided.

31 Claims, 16 Drawing Sheets

COBALT RUTHENATE THERMISTORS

FIELD OF THE INVENTION

The present invention relates to the field of thermistors, in particular cobalt ruthenate thermistors.

BACKGROUND OF THE INVENTION

The term thermistor, an acronym from thermally sensitive resistor, is accepted today as a generic name for devices made of materials, the electrical resistivity of which varies considerably with temperature. Although originally thermistors were intended for temperature measurements or for acting as temperature control elements, nowadays they have an extremely wide range of applications in various fields, for instance, in medical equipment, in the automobile industry, in communication systems. For some applications, it is desirable to achieve a maximum response of the thermistor to a temperature variation. One specific example is the use of a thermistor in the measurements of microwave power. The rate of energy flow in microwave beams is measured by allowing the beam to fall on the thermistor, the relatively small temperature rise so produced in the thermistor resulting in a relatively large change in the resistance of the thermistor, a quantity which can be determined and then serve as an indication of the microwave power. Yet, there are different uses for thermistors, where it is desirable to reduce the sensitivity of the thermistors to the temperature variation.

The thermistors are grouped according to two categories, which are defined by the arithmetic sign of the temperature coefficient of resistivity of the thermistors. This quantity, hereinafter designated as $\alpha$, is the fractional change in resistivity per unit change in temperature, as defined by the following equation:

$$\alpha \equiv \frac{1}{\rho}\frac{d\rho}{dT} \tag{I}$$

where $\rho$ is the thermistor resistivity and T is the temperature. A negative value of $\alpha$ means that the resistivity of the thermistor decreases with increasing temperature ($d\rho/dT<0$), a thermistor having a negative $\alpha$ is called NTC-thermistor, while, a PTC-thermistor is a thermistor having positive temperature coefficient of resistivity ($d\rho/dT>0$).

NTC-thermistor materials generally follow an exponential resistivity-temperature relation:

$$\rho=\rho_0 exp(\beta/T) \tag{II}$$

where $\rho_0$ is the resistivity for $T\rightarrow\infty$ and $\beta$ is a constant characteristic of the thermistor. The relation between $\alpha$, the temperature coefficient of resistivity and $\beta$, the thermistor constant, is readily obtained by introducing the expression for $\rho$, given by equation (II), into the definition (I) $\alpha$:

$$\alpha \equiv \frac{1}{\rho}\frac{d\rho}{dT} = -\frac{\beta}{T^2} \tag{III}$$

The resistivity-temperature expression (II) implies that the thermistor constant $\beta$ is the quantity that may be directly derived from the electrical measurements of a thermistor, as a plot of $\ln\rho$ versus $1/T$ should give a straight line, the slope of which equals $\beta$. Accordingly, these two quantities, $\alpha$ and $\beta$, together of course with the magnitude of the resistivity of a thermistor (at any given temperature), characterize the electrical properties of the thermistor.

NTC-thermistors are usually made of semiconducting transition metal oxides, and by controlling the chemical composition and the geometrical parameters of said NTC-thermistors, it is possible to construct devices having electrical resistance in the range of about 1 to >1,000,000 ohms at room temperature. NTC-thermistors are sometimes applied as thick film paste-like formulations, wherein the conductive phase, comprising a spinel type metal oxide, is surrounded by an inorganic binder, e.g., a glass binder, in an inert liquid medium used as vehicle, to achieve the desired electrical and transport properties for the formulation.

Cobalt ruthenate, $Co_2RuO_4$, is an example of an important spinel type ($AB_2O_4$, wherein A and B stand for metal atoms) semiconducting oxide suitable for the preparation of thick film NTC-thermistors. It is known in the art, as described in U.S. Pat. No. 5,122,302, incorporated herein by reference, that $Co_2RuO_4$ can be synthesized by drying an aqueous dispersion of approximately stoichiometric amounts of $Co_3O_4$ and $RuO_2$ and then firing the dried dispersion in air at a temperature higher than 850° C. Krutzsch and Kemmler-Sack, in Mat. Res. Bull., 18, p. 647 (1983) and in Mat. Res. Bull. 19, p. 1959 (1984) reported the preparation of various compositions of Co—Ru—O system, as well as transition metal containing compositions of said system, by a method involving extended sintering procedures. These articless in particular provide crystallographic and spectroscopic analysis for said systems, and are not directed to glass composites of said cobalt-ruthenate materials or thick film formulations comprising said cobalt-ruthenate materials.

There is a continuously increasing need for new thermistors and for a convenient, economical process for their preparation.

It is a purpose of the present invention to provide novel cobalt-ruthenate materials which are useful as thermistors.

It is another purpose of this invention to provide a process for preparing said thermistors which does not suffer from the prior art drawbacks, in particular a process involving relatively moderate conditions, such as improved energy consumption and short duration for the sintering stage, said process yielding substantially pure single phase materials as defined hereinafter.

It is yet a further object of the present invention to provide composites of said cobalt-ruthenate materials and glasses which are characterized by a variety of valuable electrical properties.

It is another object of the present invention to provide thick film formulations comprising said cobalt-ruthenate materials, said formulations being useful as thermistors.

Other objects of the present invention will become apparent as the description proceeds.

SUMMARY OF THE INVENTION

The present invention provides composites, vis, composition of matter, of cobalt ruthenate compounds of the formula $Co_{3-x}Ru_{x-y}M_yO_4$ and glass, wherein:

M is a metal selected from among Mn, Fe, Cu, Zn and Al; and x and y are numbers in the range between 0 and 2, inclusive. In a preferred embodiment of the present invention, composites of cobalt ruthenate compounds and glass are provided wherein x and y independently are equal to $n\cdot0.25$, n being an integer selected from 0 to 7, inclusive.

It has been found that the composites of cobalt ruthenate compounds and glass according to the present invention exhibit a wide range of electrical characteristics rendering said composites useful in various applications.

Accordingly, one aspect of the present invention relates to electrical uses of such composites of cobalt-ruthenate compounds and glass as NTC-thermistors, PTC-thermistors or resistors.

The present invention also provides thick film paste composition comprising:

active cobalt ruthenate compounds of the formula $Co_{3-x}Ru_{x-y}M_yO_4$, wherein:

M is a metal selected from among Mn, Fe, Cu, Zn and Al; and x and y are numbers in the range between 0 and 2, inclusive:

glass; and organic vehicle.

In a preferred embodiment of the present invention, thick film paste compositions are provided, comprising:

active cobalt ruthenate compounds of the formula $Co_{3-x}Ru_{x-y}M_yO_4$, wherein:

M is a metal selected from among Mn, Fe, Cu, Zn and Al; and x and y independently are equal to n·0.25, n being an integer selected from 0 to 7, inclusive;

glass; and organic vehicle.

In another embodiment of the present invention a process for preparing cobalt-ruthenate compounds of the formula $Co_{3-x}Ru_{x-y}M_yO_4$ is provided, wherein:

M is a metal selected from among Mn, Fe, Cu, Zn and Al; and x and y are numbers in the range between 0 and 2, inclusive, and preferably are independently equal to n·0.25, n being an integer selected from 0 to 7, inclusive;

which process comprises:

a) grinding $RuO_2$ together with $Co(OH)_2$ in a stoichiometric molar ratio according to the desired product, and when y is different from 0, also together with a metal M containing compound;

b) carrying out at least one sintering cycle of the reaction mass.

The term "sintering cycle" refers to an operation of heating the reaction mass to a chosen peak temperature and retaining the reaction mass at said peak temperature for a period of time sufficient to render said reaction mass coherent and allowing said reaction mass to cool down. Hereinafter, said peak temperature will be referred to as the temperature at which the sintering cycle is carried out.

The present invention also relates to cobalt ruthenate compounds of the formula:

$$Co_{3-x}Ru_{x-y}M_yO_4,$$

wherein:

x and y independently are equal to n·0.25, n being an integer selected from 0 to 7, inclusive; and M is a metal selected from among Mn, Fe, Cu, Zn and Al; with the provisos that when x is 1 then y is not 0 and when X is 1.5 then y is not 0.5.

Most preferred are cobalt ruthenate compounds of the formula:

$$Co_{3-x}Ru_{x-y}M_yO_4,$$

wherein x and y are as defined hereinabove, wherein n is an integer selected from 0 to 6 and M is Mn, Fe or Cu, which are single phase materials, in particular these which are selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$.

The term "single phase material" is indicative to the degree of purity of this kind of compunds, which are typically prepared by solid state reactions, and it refers to any material according to the present invention having X-ray diffraction pattern consisting of peaks which are substantially all assigned to one phase only. The X-ray diffraction patterns of the single phase materials of the present invention are typical to the spinel phase. The position of the peaks and their intensity may slightly vary depending upon the chemical composition of the specific material, as illustrated in FIGS. 1 to 6.

Another aspect of the invention relates to the use of the cobalt-ruthenate compounds according to the present invention as NTC-thermistors, their temperature coefficient of resistivity, hereinafter ($\alpha_{crbm}$, being negative in the range of temperatures between about 77 to 423° K. Typically, their resistivity at ambient temperature is higher than few tenths ohm·cm, the lower limit being pertinent in the case of the Cu-containing compounds.

DETAILED DESCRIPTION OF PREFERRED EMBODIMENTS

Figure 1:
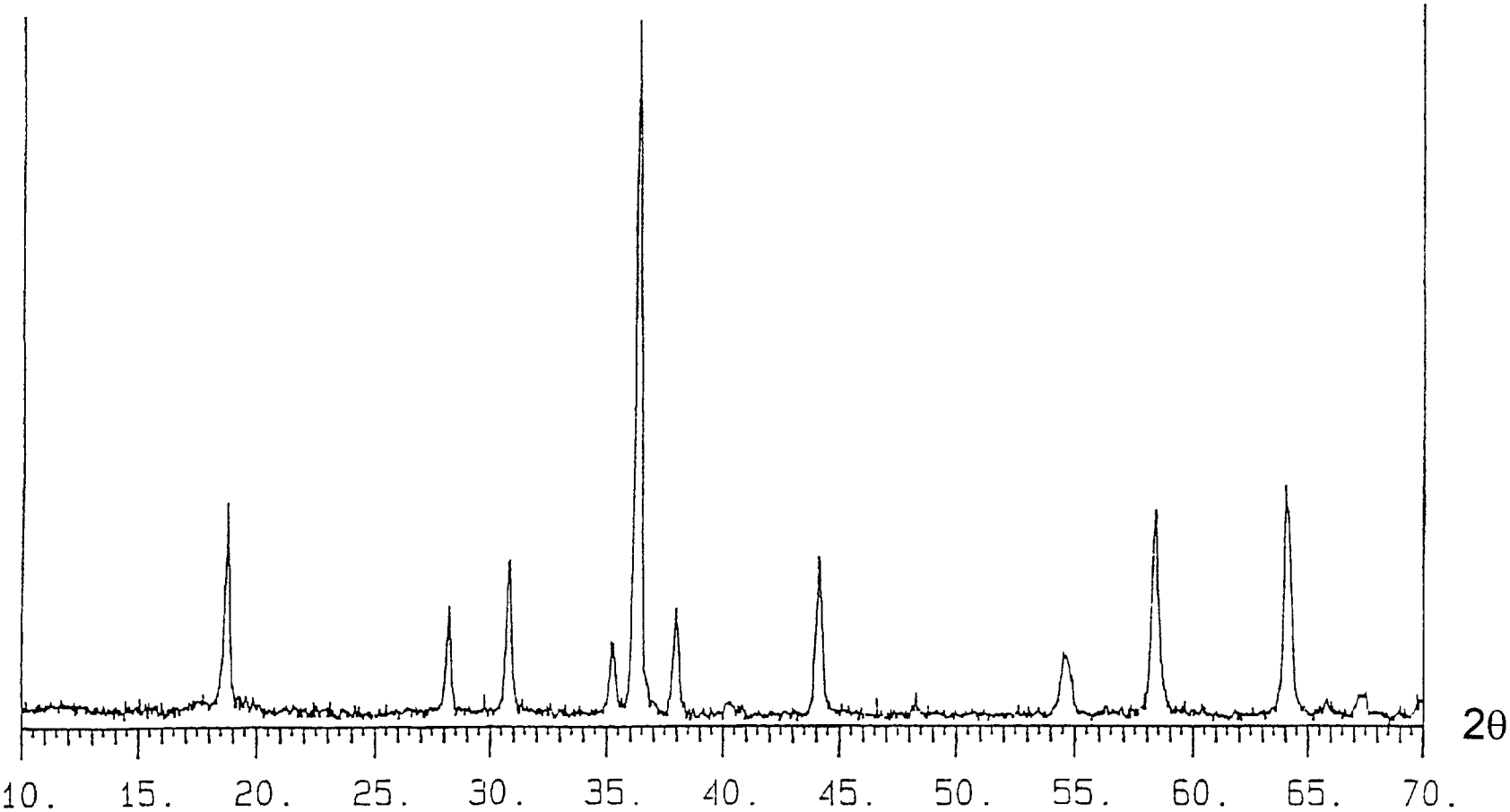
FIG. 1 represents the X-ray diffraction pattern of $Co_{2.25}Ru._{0.75}O_4$
Figure 2:
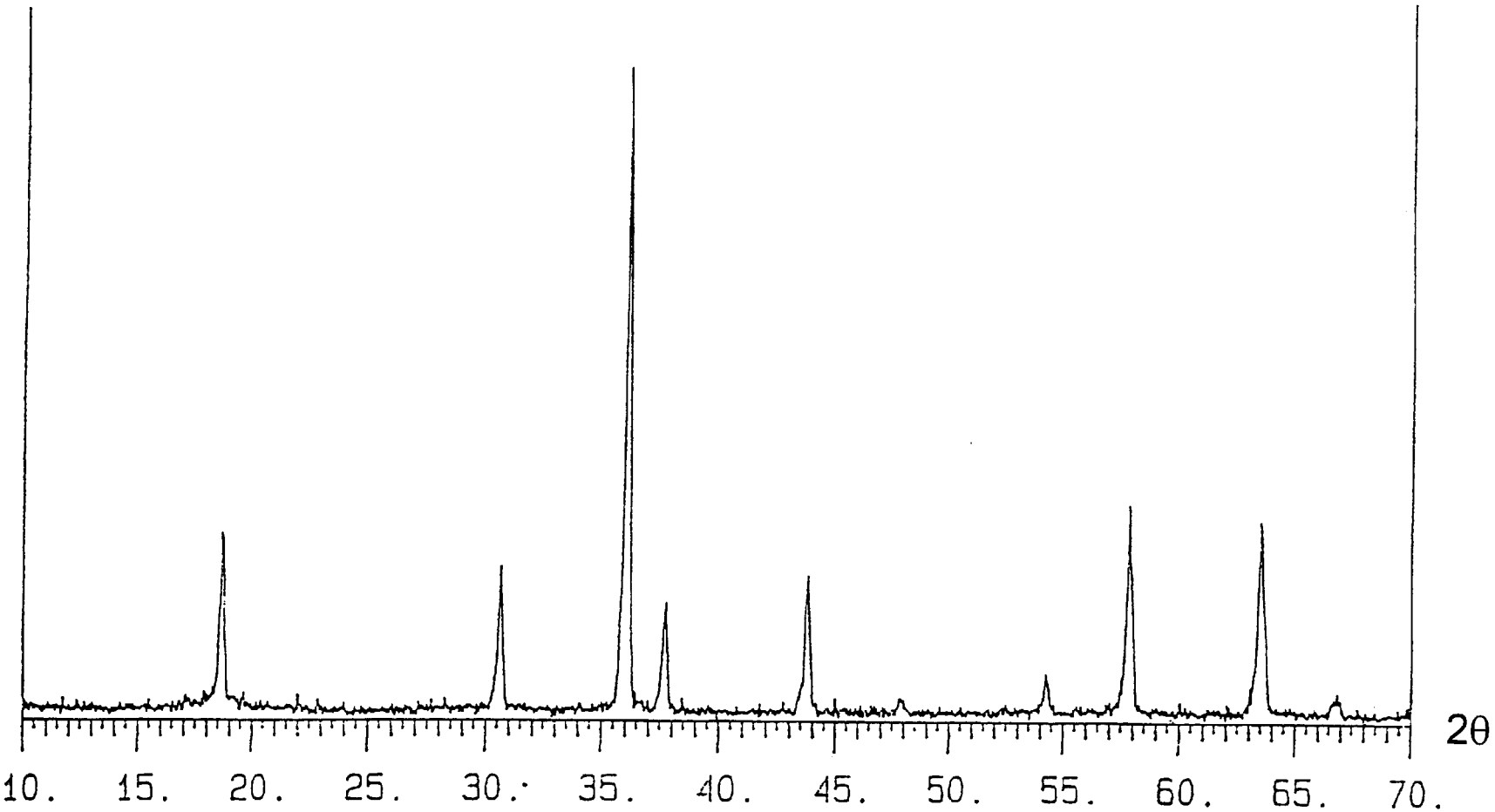
FIG. 2 represents the X-ray diffraction pattern of $Co_{2.0}Ru_{0.75}Mn_{0.25}O_4$
Figure 3:
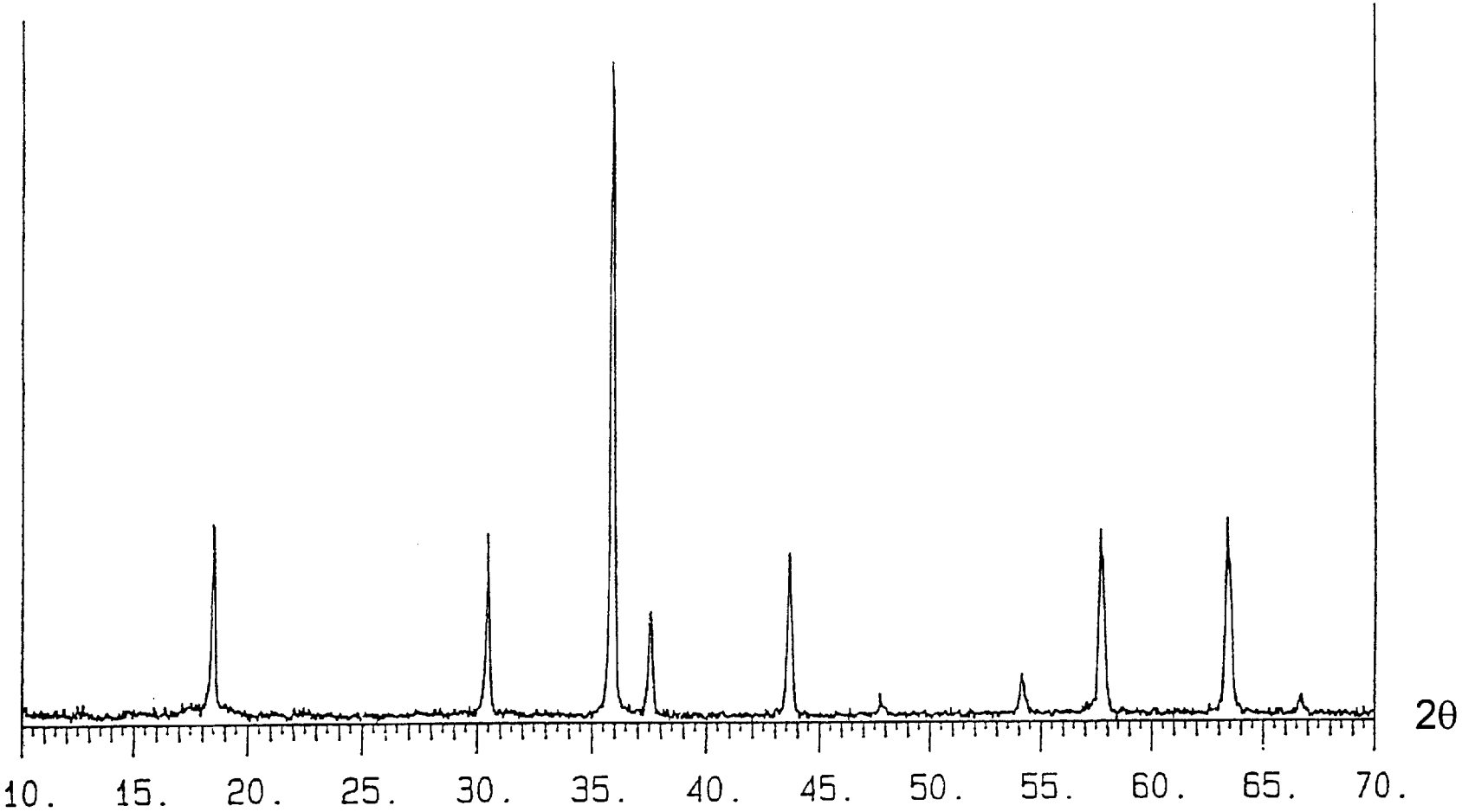
FIG. 3 represents the X-ray diffraction pattern of $Co_{2.0}Ru_{0.75}Fe_{0.25}O_4$
Figure 4:
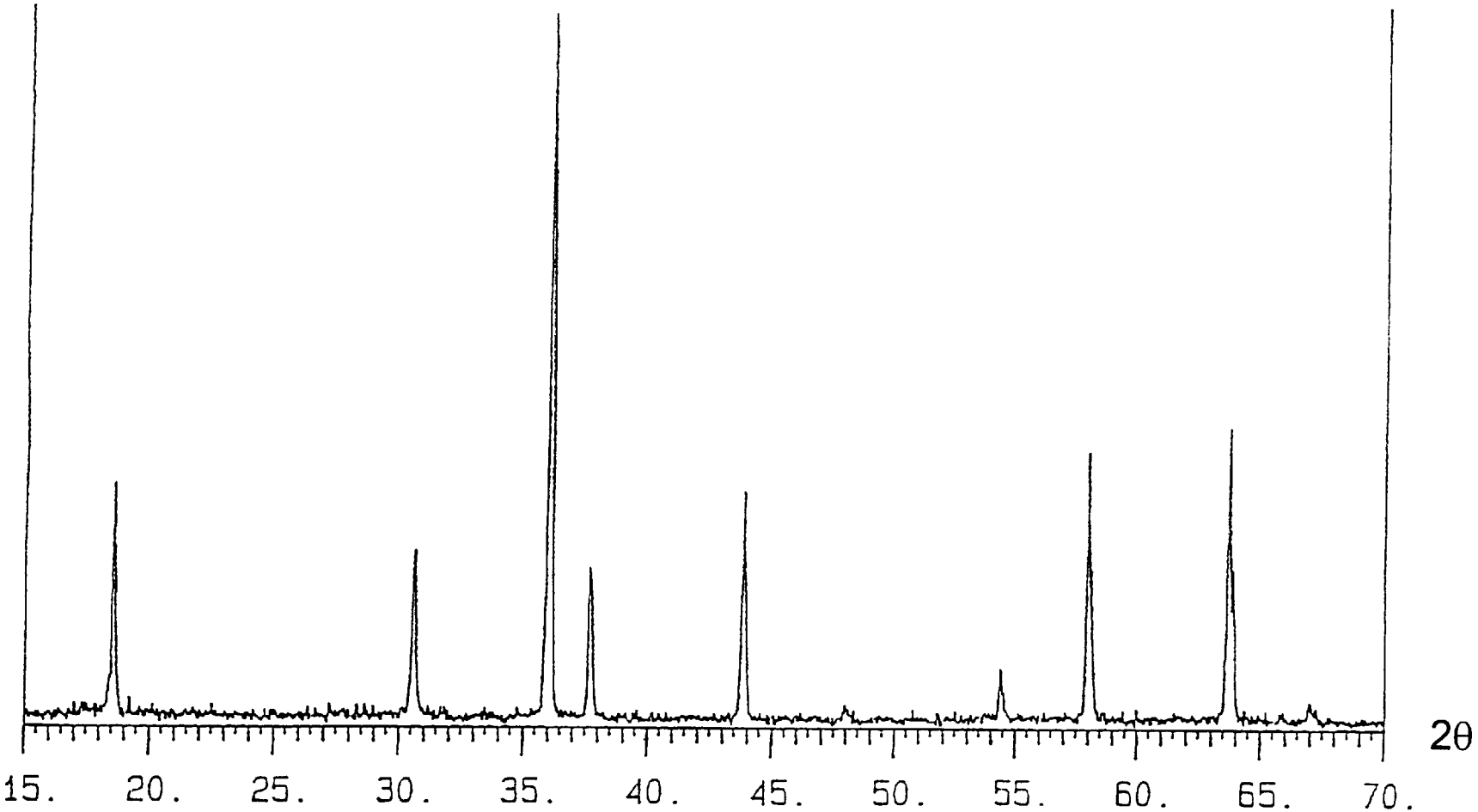
FIG. 4 represents the X-ray diffraction pattern of $Co_{2.0}Ru_{0.75}Cu_{0.25}O_4$
Figure 5:
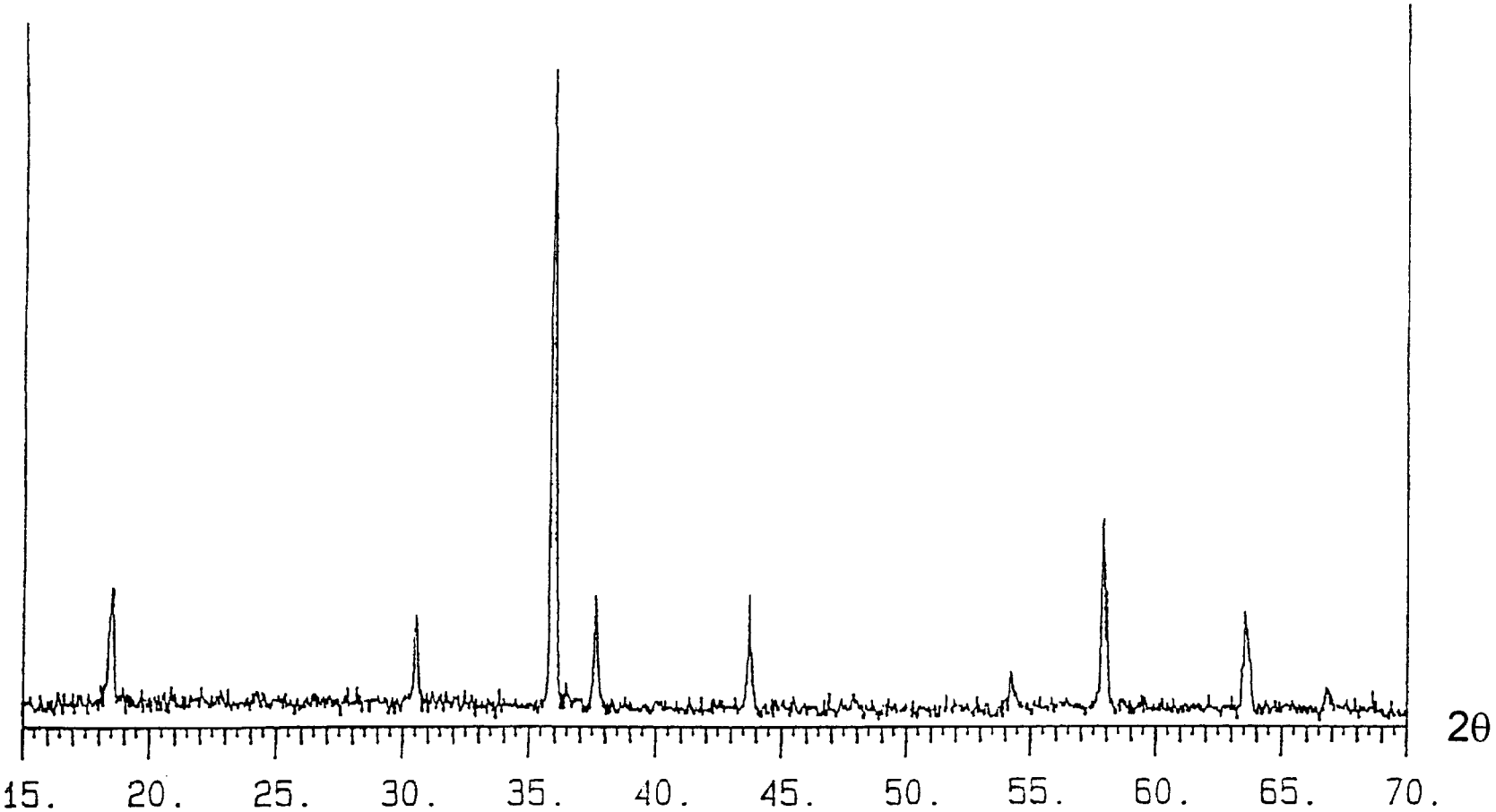
FIG. 5 represents the X-ray diffraction pattern of $Co_{1.75}Ru_{0.75}Cu_{0.5}O_4$
Figure 6:
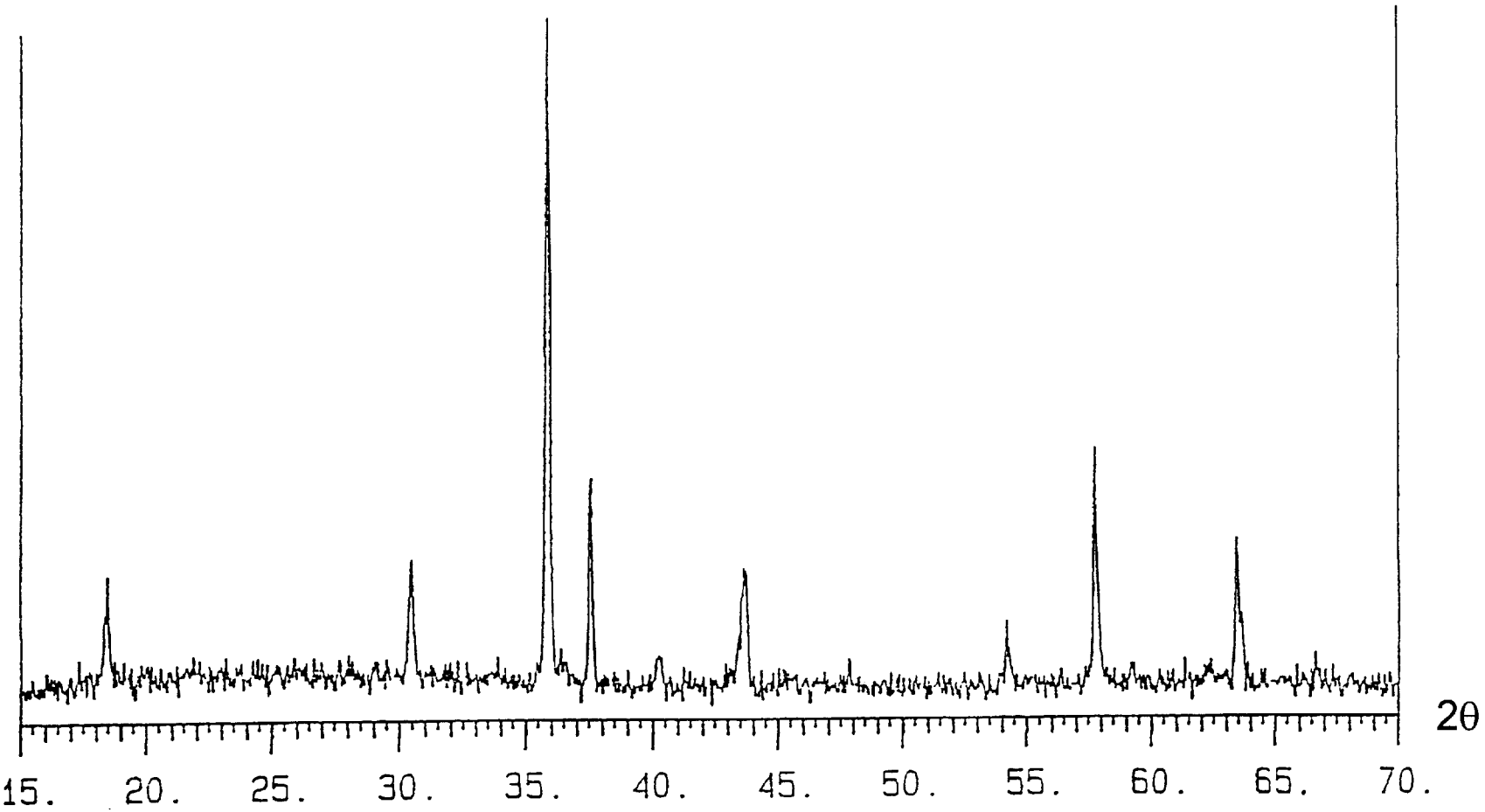
FIG. 6 represents the X-ray diffraction pattern of $Co_{1.5}Ru_{0.75}Cu_{0.75}O_4$

The novel cobalt ruthenate compounds of this invention have the formula:

$$Co_{3-x}Ru_{x-y}M_yO_4,$$

wherein:

x and y independently are equal to n·0.25, n being an integer selected from 0 to 7, inclusive; and M is a metal selected from among Mn, Fe, Cu, Zn and Al; with the provisos that when x is 1 then y is not 0 and when X is 1.5 then y is not 0.5.

Preferred among the aforesaid compounds are those defined hereinabove, wherein n is an integer selected from 0 to 6 and M is Mn, Fe or Cu, which are single phase materials. Most preferred are single phase materials selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$, as evidenced by their X-ray diffraction patterns, which are given in FIGS. 1 to 6.

The temperature coefficient of resistivity of the cobalt ruthenate compounds, $\alpha_{crbm}$, is negative in the range of temperatures between about 77 to 423° K. The electrical characteristics of said cobalt ruthenate compounds of the present invention, i.e., their resistivities as well as their thermistor constants, may vary within broad ranges of values.

According to one embodiment of the invention, single phase thermistor materials having relatively high electrical resistivity values, typically in the range between about 10 to 1000 ohm·cm at room temperature, and which are further characterized by thermistor constant having a value higher than 1000° K., preferably between 1500 to 3000° K. at the temperature range between 77 to 398° K., are provided. Most preferred compounds exhibiting such behavior are the Co (i.e., wherein y is 0), Mn and Fe containing compounds, for example, $Co_{2.25}Ru_{0.75}O_4$, $Co_{2.0}Ru_{0.75}Mn_{0.25}O_4$ and $Co_{2.0}Ru_{0.75}Fe_{0.25}O_4$.

In another embodiment of the present invention, low resistivity thermistors are provided, said thermistors having resistivities values which are in the range between 0.1 to 10 ohm·cm at room temperature, and are further characterized by thermistor constant β, values of which are—at the temperataure range between 77 to 400° K.—of the order of a few tens to a few hundreds, preferably between 100 to 500° K. Typical examples are the Cu-containing compounds, such as, for example, $Co_{2.0}Ru_{0.75}Cu_{0.25}O_4$, $Co_{1.75}$ $Ru_{0.75}Cu_{0.5}O_4$ $C_{1.5}Ru_{0.75}Cu_{0.75}O_4$.

Figure 7:
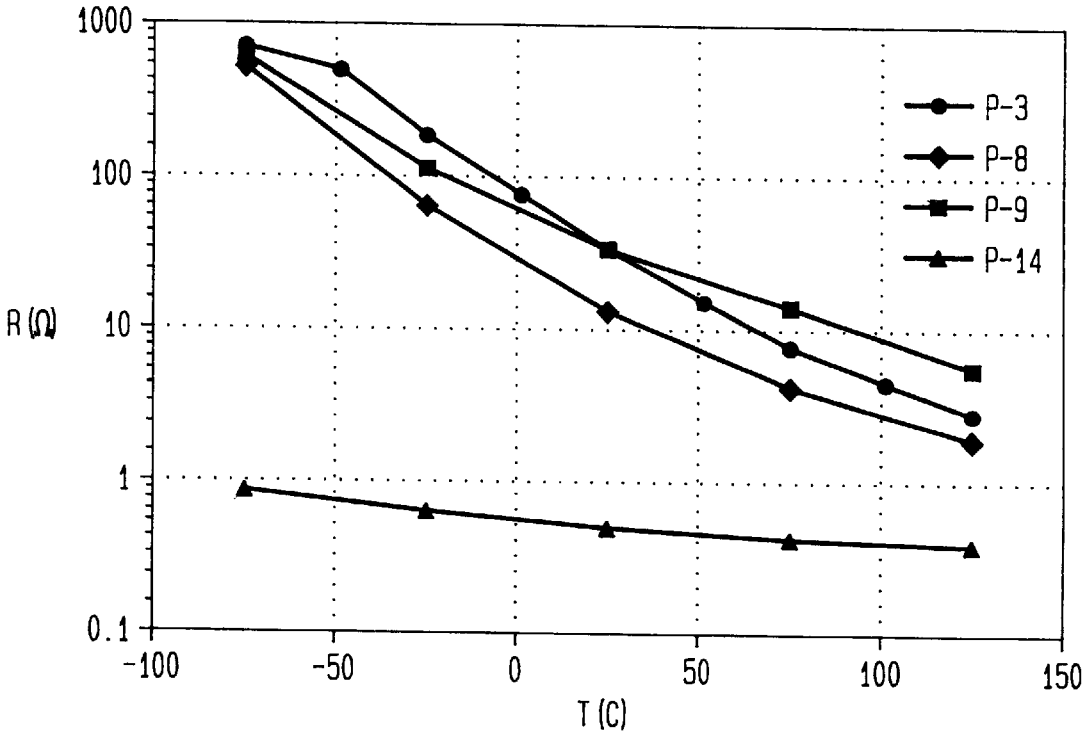
FIG. 7 illustrates the electrical resistance of the Co, Mn, and Fe containing compounds as a function of temperature.
Figure 8:
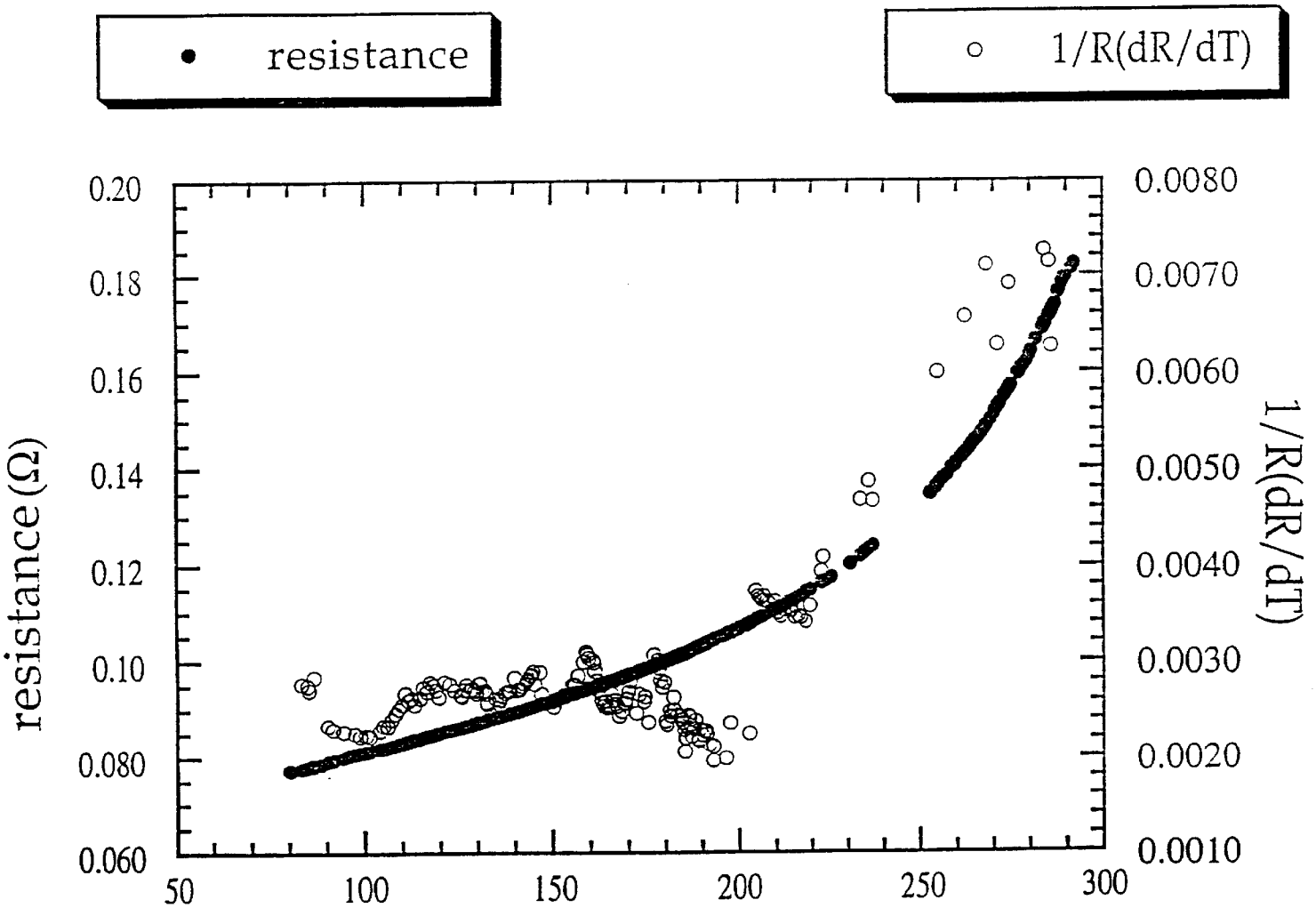
FIGS. 8 to 16 illustrate the electrical resistance and the temperature coefficient of resistivity of various composites as a function of temperature.
Figure 9:
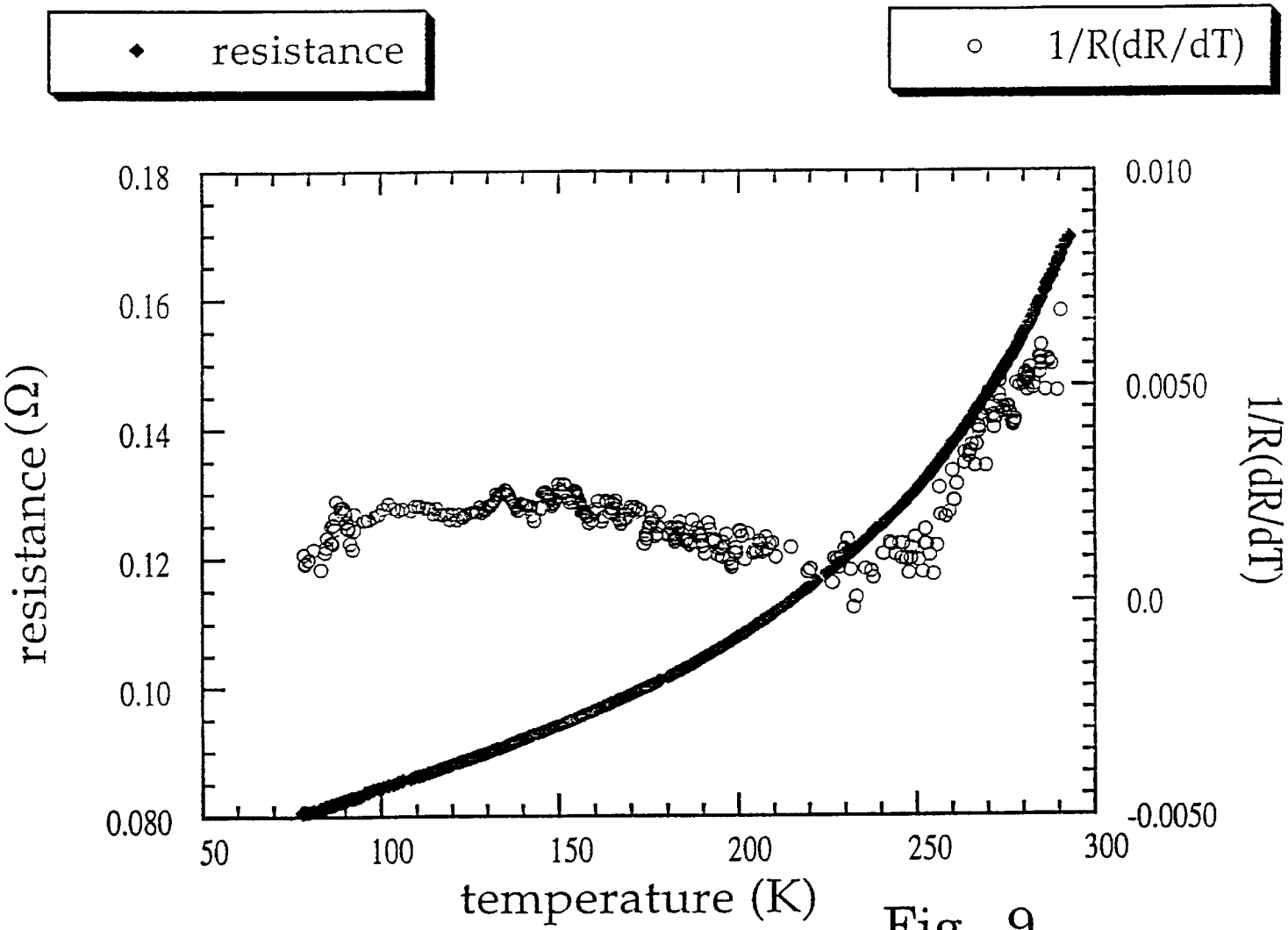
Figure 10:
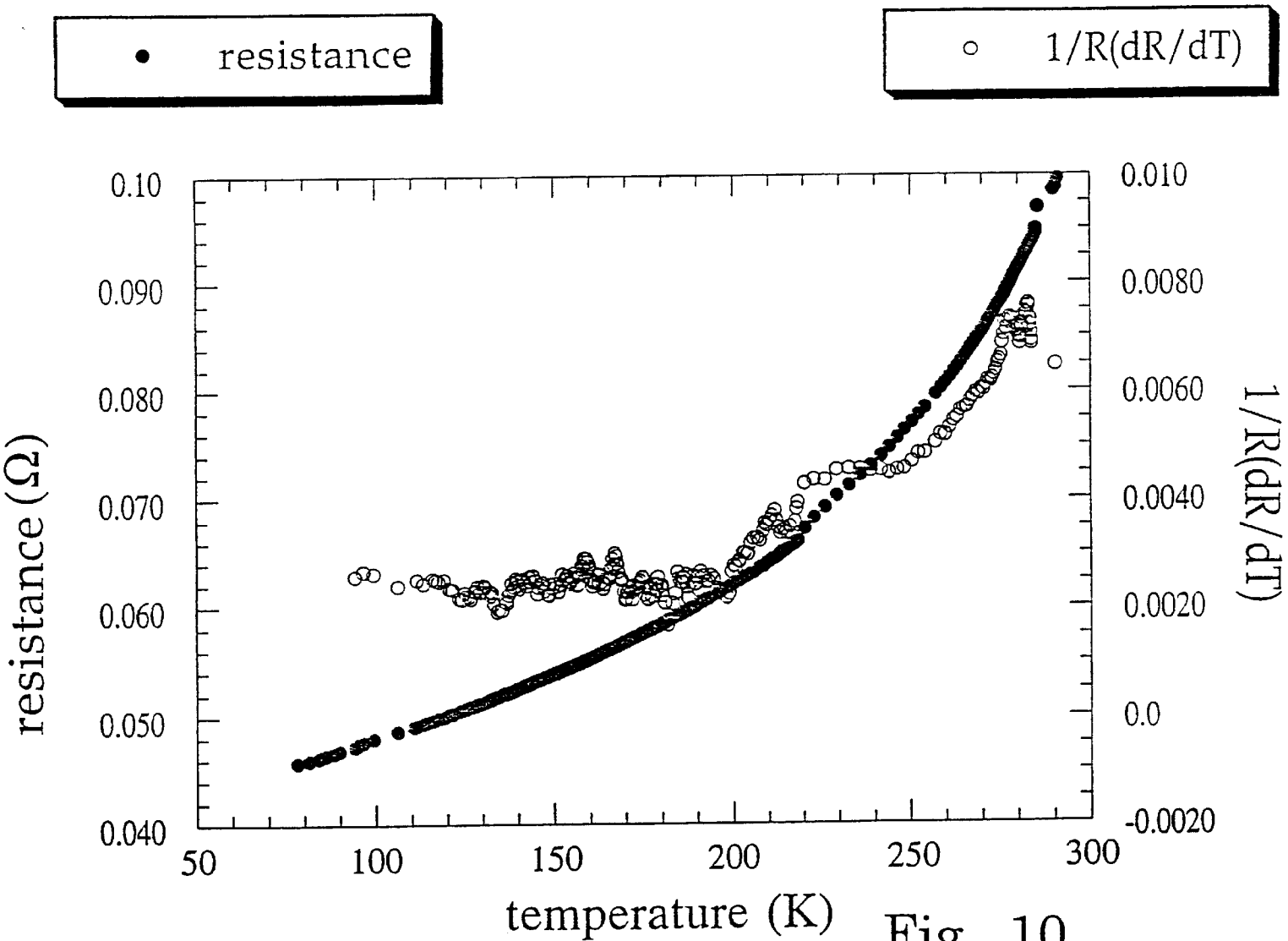
Figure 11:
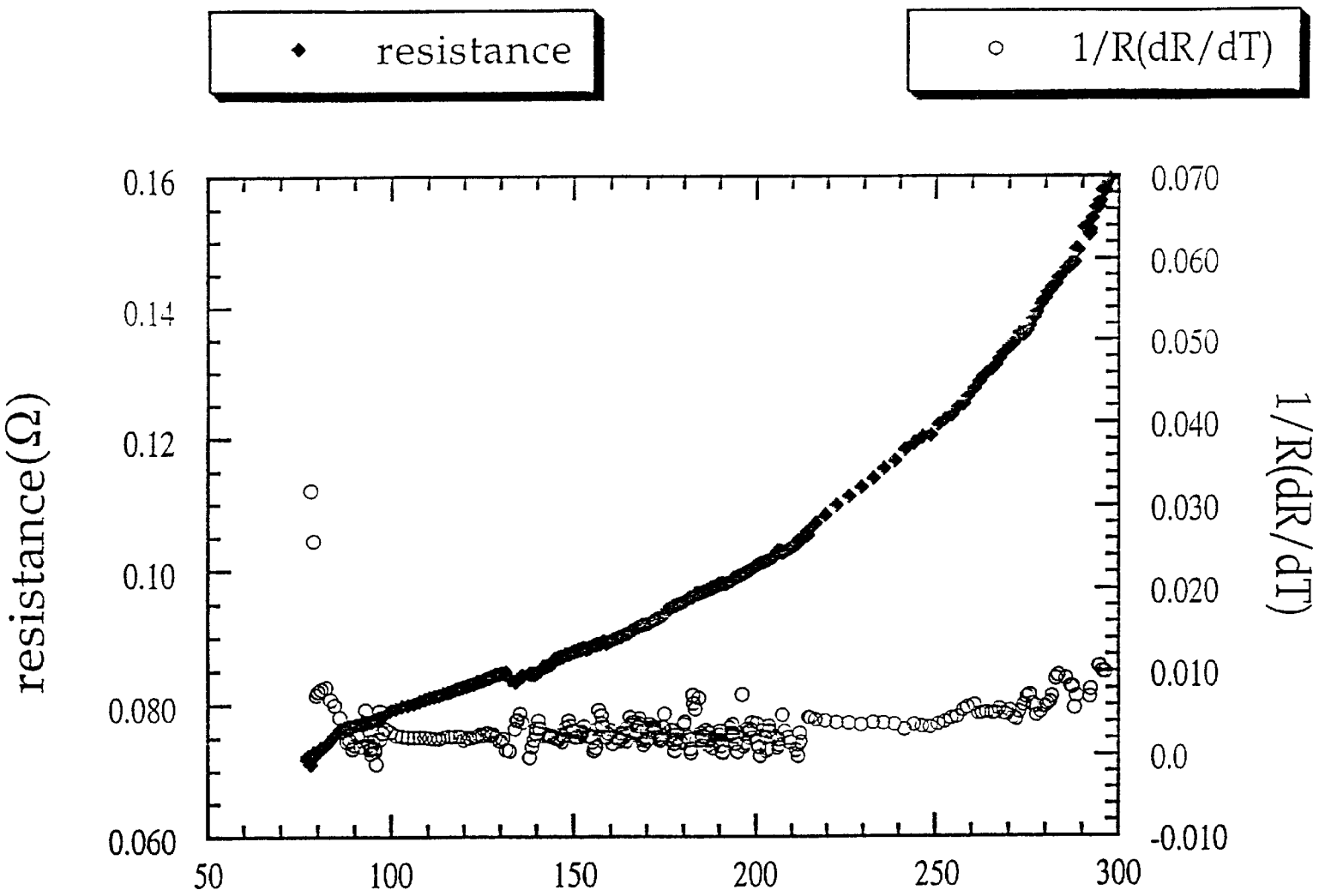
Figure 12:
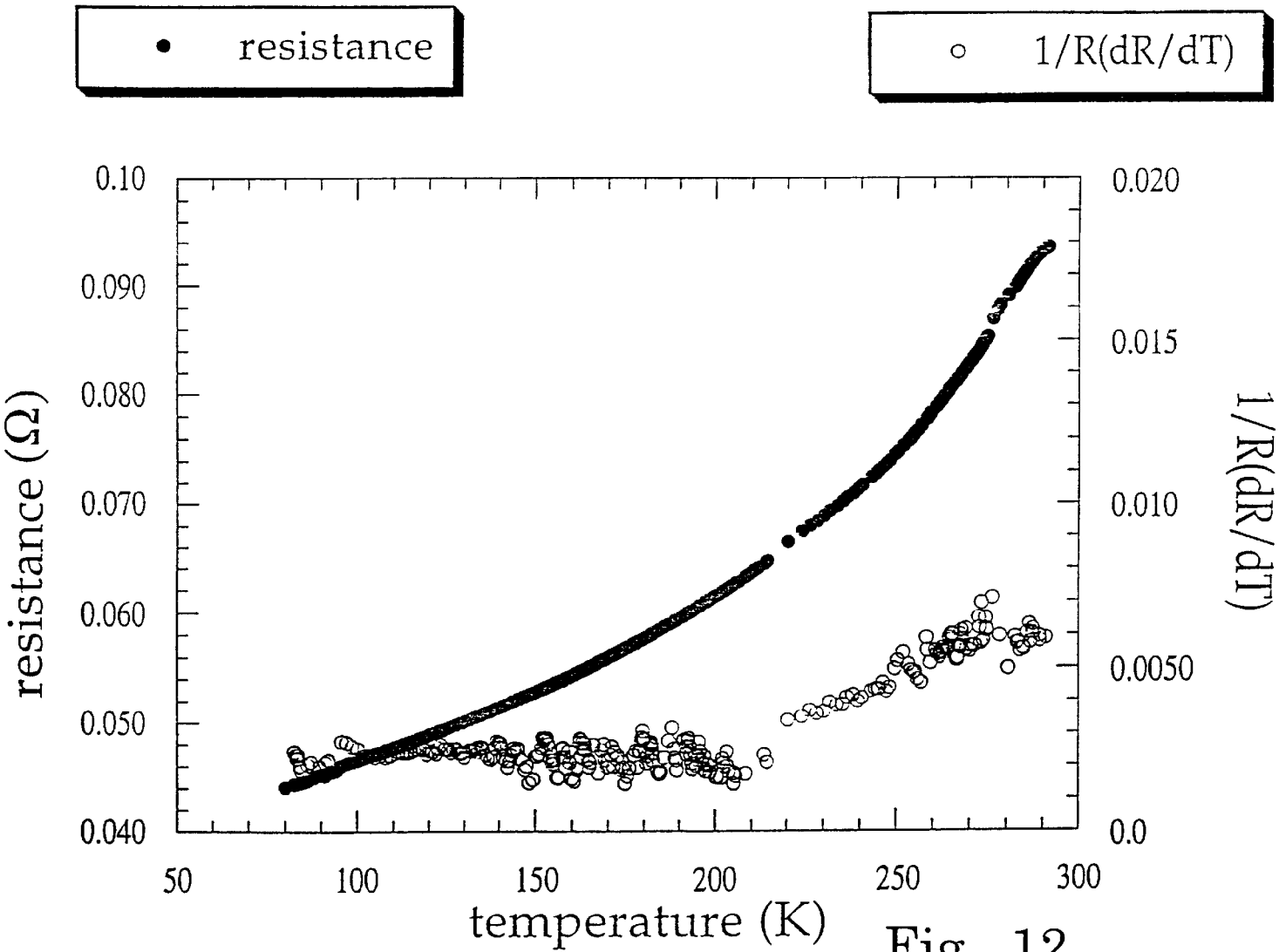

FIG. 7 illustrates the enhanced sensitivity of the electrical resistivity of the Co, Mn, and Fe containing compounds to temperature variation, compared with the behavior of the Cu containing compounds. The absolute value of the $\alpha_{crbm}$ of the Co, Mn, and Fe containing compounds will be, at the upper limit of said tempertaure range, higher than $1\cdot10^4$ ppm/deg, whereas the absolute value of $\alpha_{crbm}$ of the Cu containing compounds will be, at the same temperature, lower than $3\cdot10^3$ ppm/deg. These quantities are calculated by using equation (III), the values for β, to be substituted therein being listed hereinafter.

According to another aspect of the invention, a process is provided for the preparation of cobalt-ruthenate compounds of the formula $Co_{3-x}Ru_{x-y}M_yO_4$
wherein:

M is a metal selected from among Mn, Fe, Cu, Zn and Al; and x and y are numbers in the range between 0 and 2, inclusive, and preferably are independently equal to n·0.25, n being an integer selected from 0 to 7, inclusive;

which process comprises:

a) grinding $RuO_2$ together with $Co(OH)_2$ in a stoichiometric molar ratio according to the desired product, and when y is different from 0, also together with a metal M containing compound;

b) carrying out at least one sintering cycle of the reaction mass.

In one preferred embodiment of the invention, a metal M containing compound is an oxide or an acetate of said metal, such as, for example, $MnO_2$, $Fe_2O_3$, ZnO, $CoAl_2O_4$ and $Cu(CH_3COO)_2.H_2O$. In another preferred embodiment of the invention, an volatile liquid, for example ethanol, is introduced in the reaction mass, to allow an easier grinding of the solid components. The amount of this liquid may vary and may be easily adjusted by a person skilled in the art. Before proceeding with the sintering cycles according to step b), the liquid is allowed to evaporate.

The sintering cycle is preferably carried out by retaining the reaction mass in a vessel made of inert material, platinum for instance. Alumina vessel is generally not preferred, since it may cause the formation of a spinel phase $CoAl_2O_4$, which forms solid solutions with the cobalt-ruthenate compounds of the present invention. Each sintering cycle is preferably carried out at a temperature of at least about 900° C., more preferably at a temperature in the range between 900° C. to 1150° C., for a period of time of about 5 to 21 hours. When more than one sintering cycle is required for obtaining a single phase compound according to the present invention, the subsequent cycle is preferably conducted at a temperature higher than that of the preceding cycle. Preferably, the first cycle is conducted at a temperature in the range between 920° C. to about 1100° C. for a period of time of about 16 to 19 hours. If a subsequent sintering cycle is required, then the reaction mass will be ground again. The subsequent sintering cycle is then conducted at a temperature in the range between about 1000° C. to about 1100° C., for a period of time of about 5 to 21 hours, the lower time limit applying in particular to the high level Cu containing compounds.

At the end of each sintering cycle, the sintered material is cooled down. Preferably, the cooling down is gradual, the vessel in which the material has been heated being retained in the sintering apparatus and allowed to cool down. However, the cooling down may be speeded by quenching the reaction vessel to room temperature.

In another embodiment of the present invention, a process for the preparation of cobalt-ruthenate compounds of the formula $Co_{3-x}Ru_{x-y}M_yO_4$ is provided,
wherein:

M is a metal selected from among Mn, Fe, Cu, Zn and Al; and x and y are numbers in the range between 0 to 2, inclusive;

which process comprises:

providing a first cobalt-ruthenate compound as defined above by the aforesaid process;

providing a second cobalt-ruthenate compound as defined above by the aforesaid process;

grinding said first and second cobalt-ruthenate compounds in a stoichiometric molar ratio according to the desired product;

carrying out at least one sintering cycle as hereinbefore defined of the reaction mass.

The present invention also relates to composites comprising a cobalt-ruthenate compound of the formula formula $Co_{3-x}Ru_{x-y}M_yO_4$ and glass, wherein:

M is a metal selected from among Mn, Fe, Cu, Zn and Al; and x and y are numbers in the range between 0 and 2, inclusive.

In a preferred embodiment of the present invention, x and y independently are equal to n·0.25, n being an integer selected from 0 to 7, inclusive. Most preferred are composites of the cobalt-ruthenate compounds of the formula $Co_{3-x}Ru_{x-y}M_yO_4$ and glass, wherein x and y are as defined hereinabove, wherein n is an integer selected from 0 to 6 and M is Mn, Fe or Cu which are single phase, in particular composites comprising single phase cobalt-ruthenate materials and glass, said materials are selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$.

The term "glass" herein refers to any inorganic binder which can be used to provide a continuous matrix for the cobalt ruthenate compounds which are the active ingredients, as accepted in the field of thermistor materials. It has surprisingly been found that the composites containing the cobalt-ruthenate compounds and glass according to the present invention, in particular those involving the single phase materials, exhibit electrical and magnetical behavior which, in many cases, is substantially different from the behavior of the active cobalt ruthenate compounds. According to this surprising embodiment of the invention, it is possible to expand the uses of the novel cobalt-ruthenate compounds far beyond the use as NTC-thermistor. The important properties of the composites will become apparent as the description proceeds.

Preferably, the glasses according to the present invention have a softening point in the range between 400° C. to 850° C. Compositionally, the preferred glasses for use in the present invention are glasses containing Pb or Bi, but other glasses, free of these metals, may well be applied, such as Microscope Corning glass. Typically, the Pb or Bi glasses contain about 10 to 60 mole percent silica, in addition to the oxides of Pb or Bi or mixtures thereof in amount of about 5 to 70 mole percent, optionally in the presence of transition metal oxides, the atomic numbers of said tansition metals being between 22 to 30, exclusive, in particular oxides of Co, Fe, Zn, Mn or mixtures thereof and optionally in the presence of glass forming oxides and/or conditional glass forming oxides, preferably those selected from among $TiO_2$, $Al_2O_3$, $B_2O_3$ and $ZrO_2$, preferably in an amount between 2 to 30 mole percent of the total weight of the glass.

The amount of $Bi_2O_3$ contained in the glasses for use in the composites according to the present invention can range from 5 to 70 mole percent, preferably around 50 mole percent of the total weight of the glass. The amount of PbO contained in the glasses may vary between 5 to 70, preferably 40 to 60 mole percent of the total weight of the glass. The preparation of such glasses is well known in the art, and is described, for instance, in U.S. Pat. No. 5,491,118 and in U.S. Pat. No. 5,122,302. The compositions of some preferred Pb or Bi—containing glasses according to the present invention are given in Table I. Hereinafter, the glasses will be referred to according to the designation given in Table I.

TABLE I

| | A* | B* | C | D | E |
|---|---|---|---|---|---|
| $SiO_2$ | 25.2 | 28.0 | 30 | 30 | 30 |
| $Bi_2O_3$ | | | 50 | 50 | 50 |
| PbO | 50.1 | 55.9 | | | |
| ZnO | | | 20 | | |
| $Fe_2O_3$ | | | | 20 | |
| CoO | | | | | 20 |
| MnO | 6.5 | | | | |
| $Al_2O_3$ | 4.1 | 4.7 | | | |
| $B_2O_3$ | 14.1 | 8.1 | | | |
| $TiO_2$ | | 3.3 | | | |

*given in weight percent

The total amount of the glass in the composite may have an important effect on the properties of the composite. Generally, the amount of glass will vary between about 5% to about 80% weight, more preferably between 10% to 60% weight. Hereinafter, the amount of glass contained in the composite comprising the cobalt-ruthenate compound and glass is given in weight percent. As will be illustrated hereinafter, the type of the glass, as well as the exact fraction of the glass in the composite may control, in some cases, the resulting electrical properties of the composite.

As indicated hereinbefore, the electrical characteristics of the cobalt ruthenate compounds of the invention render them useful as NTC-thermistors, as they satisfy two conditions: their temperature coefficient of resistivity, $\alpha_{crbm}$, is negative in the temperature range between 77 to 400° K., and their resistivity values are within the typical range for NTC-thermistors, as discussed hereinabefore.

The electrical properties of the composites containing the cobalt-ruthenate compounds and glass according to the present invention are much more varied, as the glass modifies the resistivity values and the resistivity-temperature relation. The temperature coefficient of resistivity of the said composites, hereinafter $\alpha_{composite}$, which—by definition—has the arithmetic sign of $d\rho/dT$, i.e., the sign of the derivative of the resistivity with respect to temperature, will be used in the aforecoming description, to illustrate the electrical properties and the advantages of the composites. Additional parameter which will be used to describe said properties is the electrical resistivity of the composite, in particular the value of electrical resistivity of the composite at room temperature.

In one embodiment, the composites of the present invention have a temperature coefficient of resistivity $\alpha_{composite}$ which is positive in at least a portion of the temperature range between about 77° K. to 300° K., $\alpha_{composite}$ may be temperature dependent or substantially constant in said temperature range.

In one variant of the embodiment wherein $\alpha_{composite}$ is temperature dependent, $\alpha_{composite}$ maintains positive values throughout the entire temperature range between about 77° K. to 300° K., the resistivity of the composite being an increasing, substantially non-linear monotonic function of temperature in that range. In a second variant of the embodiment, wherein $\alpha_{composite}$ is temperature dependent, $\alpha_{composite}$ may change its arithmetic sign upon temperature variation, being positive in at least one portion of the range between about 77° K. to 300° K. and negative in a complementary portion, the resistivity being non-monotonic function of the temperature in the range between about 77° K. to 300° K.

In another embodiment of the invention wherein $\alpha_{composite}$ is positive throughout the range between about from 77° K to 300° K, $\alpha_{composite}$ is not temperature dependent, having an approximately constant value in said range, the resistivity of the composite being a substantially increasing linear function of temperature.

According to another embodiment, some of the composites of cobalt-ruthenate compounds and glass may have a resistivity which is a substantially decreasing monotonic function of temperature in the entire range between about 77° K. to 300° K, i.e., $\alpha_{composite}$ is negative throughout said temperature range. These composites retain the electrical properties of the pure cobalt ruthenate compounds and may be used as NTC-thermistors.

The terms "monotonic" and "non-monotonic" are to be understood as follows in the present context, with respect to the arithmetic signs of $d\rho/dT$, i.e., of $\alpha_{composite}$:

when the resistivity is an increasing monotonic function of the temperature, $\alpha_{composite}$ is positive in the entire temperature range between about 77° K. to 300° K.; and when the resistivity is a decreasing monotonic function of the temperature, $\alpha_{composite}$ is negative in the entire temperature range between about 77° K. to 300° K.; and in the case of non-monotonic function, $\alpha_{composite}$ is positive in at least a part the temperature range between about 77° K. to 300° K., and is negative in at least another part of said temperature range.

In one preferred aspect of the invention, the composites have an $\alpha_{composite}$ that is positive in the entire temperature range between 77 to 300° K. and is temperature dependent, and $\alpha_{composite}$ may have relatively high values, in particular at room temperature, preferably reaching values in the range between about 2500 to 8000 ppm/deg, most preferably in the range about 5000 to 7000 ppm/deg at said temperature, said composites having, at said temperature, resistivity lower than 5 ohm·cm, preferably lower than 1.0 ohm·cm, most preferably lower than 0.3 ohm·cm. Said composites, therefore, exhibit a metallic behavior, since it appears—though the inventors do not wish to be bound to any theoretical explanation of this phenomena—that the glasses unexpectedly alter the properties of the cobalt ruthenate compounds, producing a transition from semiconductor to metal behavior, in the sense that the negative $\alpha_{cbrm}$, characteristic of the pure semiconducting NTC-compounds, changes its sign to become a corresponding positive $\alpha_{composite}$. Accordingly, these composites will be hereinafter referred to as metal-like composites.

In one variant of the above embodiment, the glasses comprised in said metal-like composites are Pb containing glasses, designated as A and B in table I.

The glass designated as A in table I is in particular useful to render metallic the properties of composites comprising, as the active ingredient, single phase $Co_{2.25}Ru_{0.75}O_4$, Mn or low level Cu containing cobalt ruthenate material, for example, single phase $Co_{2.0}Ru_{0.75}Mn_{0.25}O_4$ or $Co_{2.0}Ru_{0.75}Cu_{0.25}O_4$. In said composites, said glass preferably constitutes about 15 to 45 percent of the total weight, more preferably between 20 to 40%, whereas in the case of $Co_{2.0}Ru_{0.75}Mn_{0.25}O_4$, generally glass contents around the upper limit are preferred.

The glass designated as B in table I is in particular useful in providing metal-like composites having the characteristics detailed above when the active material is Cu- containing cobalt ruthenate compound, such as, for example, $Co_{1.75}Ru_{0.75}Cu_{0.5}O_4$ or $Co_{1.5}Ru_{0.75}Cu_{0.75}O_4$, which are single phase, and $Co_{1.25}Ru_{0.75}Cu_{1.0}O_4$, which is not a single phase material. The appropriate amount of the said glass in the composite preferably varies between 15 to 45 percent of the total weight, preferably between 20 to 40%.

In another variant of the above embodiment of metal-like composites, it has been found that glasses containing Bi, which are Cd and Pb-free, preferably such glasses which in addition contain also Co, Fe or Zn, for example, the glasses designated as C, D and E in table 1, are useful in producing metal-like composites, in particular when the active cobalt ruthenate compound is chosen from among the above mentioned single phases $Co_{2.25}Ru_{0.75}O_4$, $Co_{2.0}Ru_{0.75}Mn_{0.25}O_4$, and Cu-containing cobalt ruthenate compounds such as single phase $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$, and $Co_{1.25}$ $Ru_{0.75}$ $Cu_{1.0}O_4$, which is not single phase. In said composites, said glasses constitute about 15 to 45 percent of the total weight of the composite, preferably between 20 to 40%, the contents of the glass designated as E in table 1 is preferably around 40% in the composites comprising, as the active material, $Co_{2.0}Ru_{0.75}Mn_{0.25}O_4$ or Cu-containing compounds.

FIGS. 8, 9, 10, 11, and 12 illustrate the resistance-temperature functions of some metal-like composites. While the resistivity is the quantity characteristic of the matter, in this figures, for the sake of convenience, the resistance—rather than the resistivity—is plotted versus the temperature, since the resistance is the quantity which is actually measured and monitored. The resistance is directly proportional to resistivity via constant determined by the geometrical parameters of the object used in the measurements, so the transformation between these microscopic and macroscopic physical quantities is straightforward when the length and the area of cross section of the object are given: $\rho=R\cdot A/l$, wherein R designates the resistance of the object, ρ designates the resistivity and I and A designate the length and the area of cross-section, respectively. Accordingly, table II indicates the calculated resistivity at one chosen temperature, i.e., at room temperature, as well as the value of $\alpha_{composite}$ at room temperature (the value of $\alpha_{composite}$ is not effected if the resistance, rather than the resistivity, is introduced in equation I).

The resistance functions represented in said figures are substantially increasing monotonic functions of temperature, through the entire temperature range between about 70° K. to 300° K., wherein composite is temperature dependent reaching relatively high values at room temperature.

The compositions of the composites which are referred to in these figures and their electrical characteristics are detailed in Table II (the abbreviations for the various glasses are referred to in table I):

TABLE II

| FIG. # | composition | ρ at room temperature (ohm·cm) | $\alpha_{composite}$ at room temperature (ppm/deg) |
|---|---|---|---|
| 8 | glass- A (20%) active material- $Co_{2.25}Ru_{0.75}O_4$ | 0.28 | ~7000 |
| 9 | glass- A (40%) active material- $Co_{2.25}Ru_{0.75}O_4$ | 0.22 | ~6000 |
| 10 | glass- A (40%) active material- $Co_{2.0}Ru_{0.75}Mn_{0.25}O_4$ | 0.20 | ~7000 |
| 11 | glass- B (40%) active material- $Co_{1.5}Ru_{0.75}Cu_{0.75}O_4$ | 0.16 | ~7000 |
| 12 | glass- B (20%) active material- $Co_{1.25}Ru_{0.75}Cu_{1.0}O_4$ | 0.91 | ~6000 |

In another embodiment of the invention, composites of cobalt-ruthenate compounds and glass are provided, characterized in that $\alpha_{composite}$ is positive in the entire temperature range between 77 to 300° K., with a substantially constant value.

Figure 13:
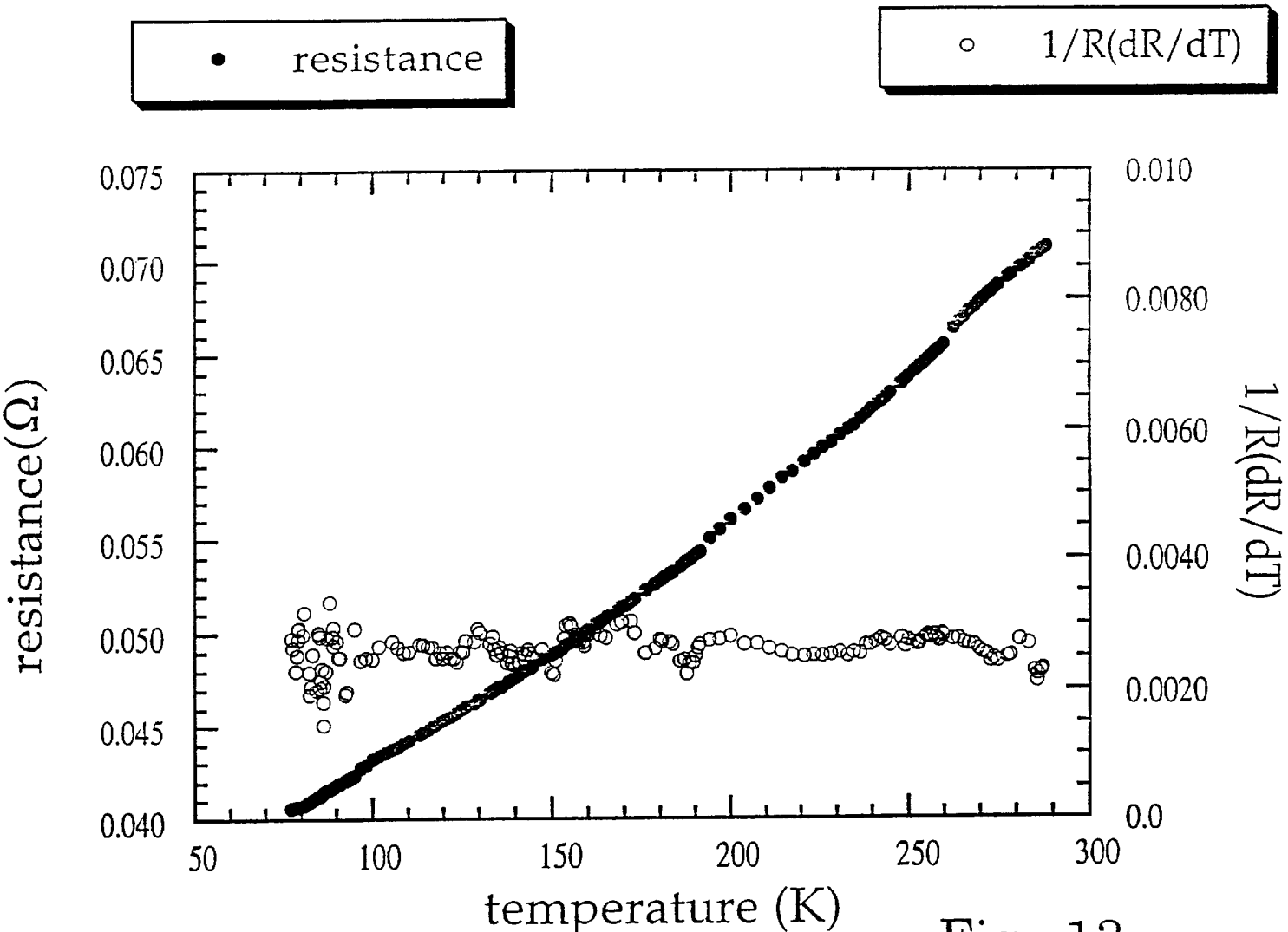

In one variant of this embodiment, composites of cobalt-ruthenate compounds and glass are provided wherein $\alpha_{composite}$ is positive in the entire temperature range between 77 to 300° K., with a substantially constant value, which may be relatively high, typically between about 1000 to 4000 ppm/deg, more typically around between 2000 to 3000 ppm/deg. FIG. 13 illustrates the resistance of a composite comprising a single phase $Co_{2.0}Ru_{0.75}Cu_{0.25}O_4$ as the active phase, and the glass designated as A in Table I (20% by weight), as a function of temperature. The resistance is a substantially increasing linear function of temperature in said temperature range.

Figure 14:
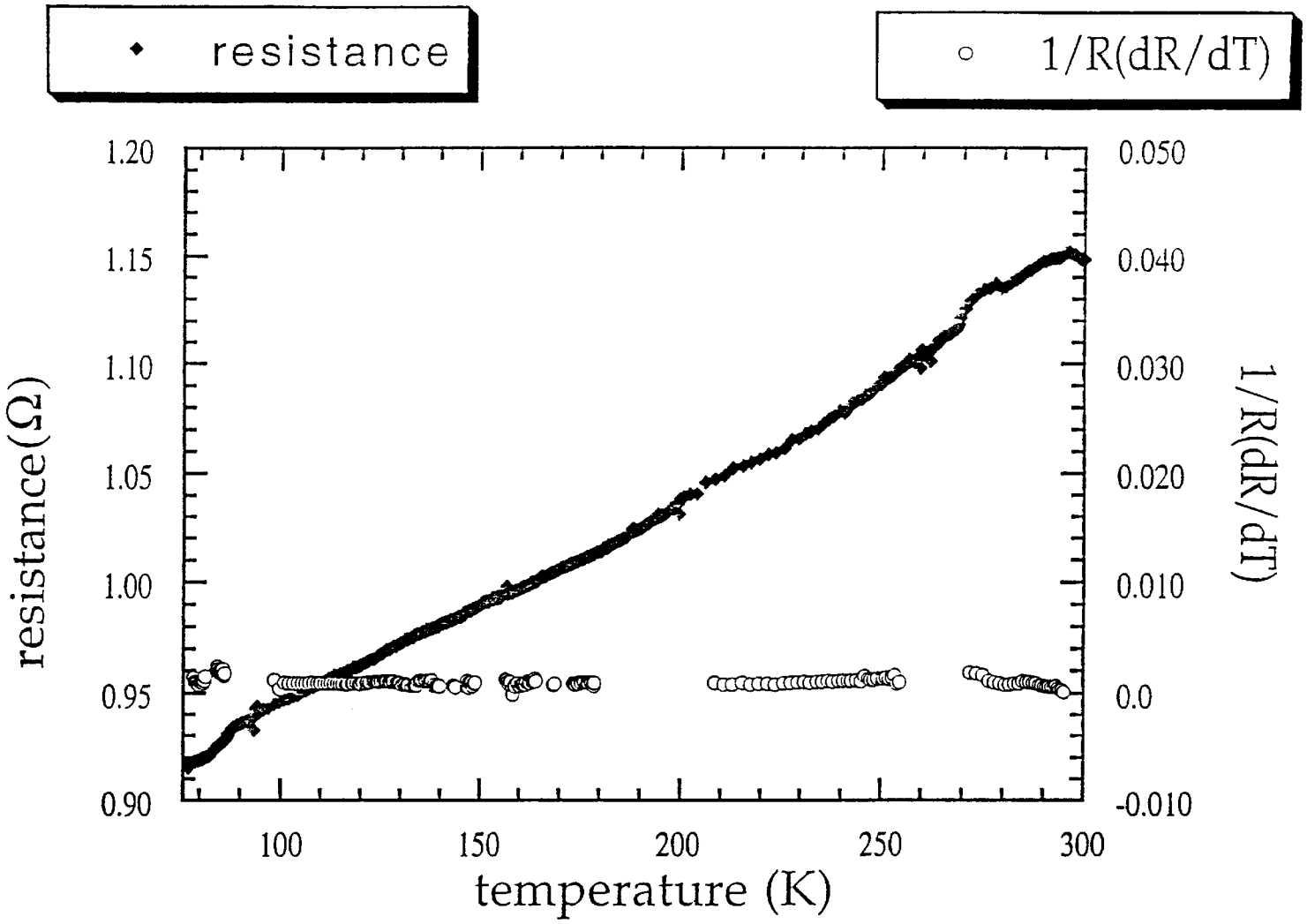

In another variant of this invention, composites of cobalt-ruthenate compounds and glass are provided wherein $\alpha_{composite}$ is positive in the entire temperature range between 77 to 300° K., with a substantially constant value, which is relatively small, preferably in the range between about few ppm/deg to several hundreds ppm/deg, said composites having, at ambient temperature, electrical resistivity lower than 0.25 ohm·cm, the resistance being an increasing linear function of the temperature in said temperature range. Said composites are characterized by weak metallic behavior, and will be hereinafter referred to as weak-metal like composites. The content of the glass varies between 10% to 50% (by weight), but in general percent around 40 is preferred. Some preferred composites falling within this category may be selected from the group consisting of composites comprising $Co_{2.25}Ru_{0.75}O_4$ and Bi containing glass such as glass C (40% of the total weight of the composite); single phase $Co_{2.0}Ru_{0.75}Fe_{0.25}O_4$ and Bi containing glass such as glasses C and E (40% of the total weight of the composite). FIG. 14 illustrates the resistance-temperature relation of a weak metal-like composite, the represented function being a substantially increasing, linear, function through the entire temperature range between about 70° K. to 300° K., $\alpha_{composite}$ itself is not temperature dependent and maintains a relatively low value, around 100 ppm/deg, the composite therefore exhibiting resistor features, the temperature coefficient of resistivity being small and substantially constant in the above temperature range. The glass composite which is referred to in FIG. 14 comprises $Co_{1.75}Ru_{0.75}Cu_{0.5}O_4$ and the Pb containing glass designated as B in table I (40% by weight).

Another preferred embodiment of the present invention relates to composites characterized in that their $\alpha_{composite}$ parameter is positive in at least a partial range in the temperature range between about 77° K. to 300° K., and is very strongly temperature dependent in said partial range. The term "very strongly temperature dependent" herein indicates a very significant change, of about 10 to 50% in the value of the resistivity within a range of few degrees or less. This abrupt drop in the resistivity of the composite is reflected by the $\alpha_{composite}$ parameter which reaches high positive values in said narrow, low temperature range. Typically, the resistivity drops in about 30%, said drop occurring in the vicinity of a temperature in the range of about liquid nitrogen temperture to 80° K., in particular around 80° K., providing a kind of phase transition in terms of resistivity, namely, a metal to superconductor-like transition. Composites belonging to this category will be referred to hereinafter as superconductor-like composites, and may find use as very sensitive temperature sensors. Preferably, said superconductor-like composites comprise Pb containing glasses, such as these designated as A and B in table I, and—as the active substance—single phase $Co_{2.25}Ru_{0.75}O_4$. It has been found that the amount of glass contained in the composite is an important factor determining whether the composite becomes superconductor-like or not: composites made of the same ingredients but with different active material/glass ratio may behave in a different manner, as will be hereinafter exemplified.

In another preferred embodiment of the present invention, composites are provided having $\alpha_{composite}$ which is temperature dependent, wherein the temperature dependence is characterized in that said $\alpha_{composite}$ changes its arithmetic sign upon temperature variation, being positive in at least a portion of the range between about 77° K. to 300° K. and negative in at least another portion thereof, the resistivity-temperature relation being a non-monotonic function in said temperature range between 77° K. to 300° K., and preferably exhibiting one local maximum or minimum in said range, the temperature to which said maximum or minimum is related, hereinafter $T_{transition}$, indicating the transition from the metal-like regime wherein $\alpha_{composite}$ is positive to a semiconductor-like regime wherein $\alpha_{composite}$ is negative. Preferably, said composites comprise Pb containing glasses, such these designated as B in table I, and—as the active substance—single phase $Co_{2.25}Ru_{0.75}O_4$. It has been found that the amount of glass contained in the composite is an important factor determining whether the composite will have the above listed properties or not: composites made of the same ingredients but with different active material/glass ratio may behave in a different manner.

Figure 15:
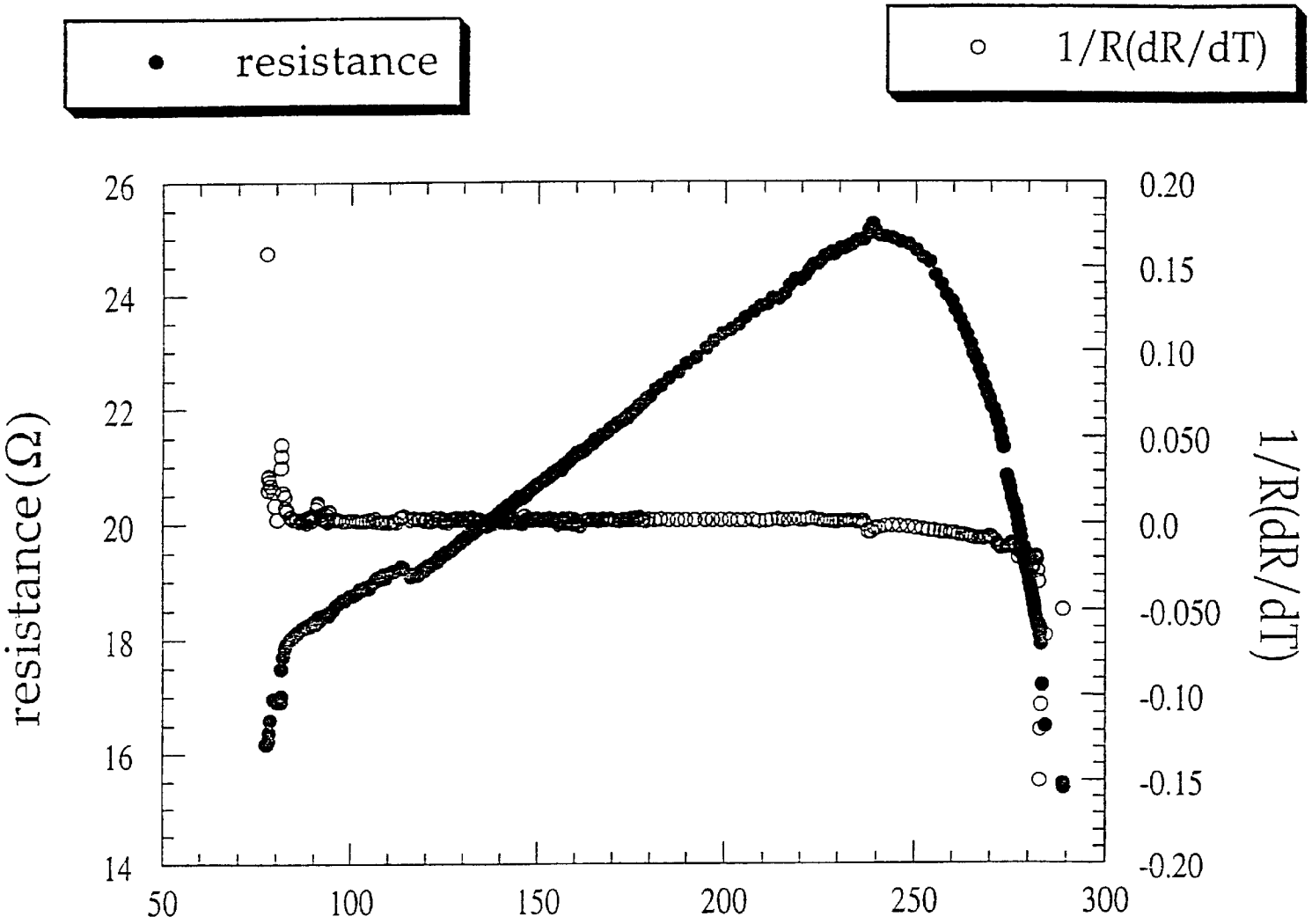

FIG. 15 illustrates the resistance-temperature relation of a superconductor-like composite comprising $Co_{2.25}Ru_{0.75}O_4$ and glass B (20 weight %), exhibiting the phase transition in terms of resistivity defined hereinabove at about 80° K., $\alpha_{composite}$ being very strongly temperature dependent at the vicinity of said temperature, reaching a very high value as shown in the figure. In addition, the illustrated composite exhibits metal-to- semiconductor transition as described above: the resistance-temperature relation is a function characterized by a local maximum at $T_{transition}$≡240° K., the composite being metal-like, as hereinbefore defined, at temperatures lower than said $T_{transition}$, where $\alpha_{composite}$ is positive, and being NTC-thermistor at temperatures higher than said $T_{transition}$, where ($\alpha_{composite}$ is negative.

Figure 16:
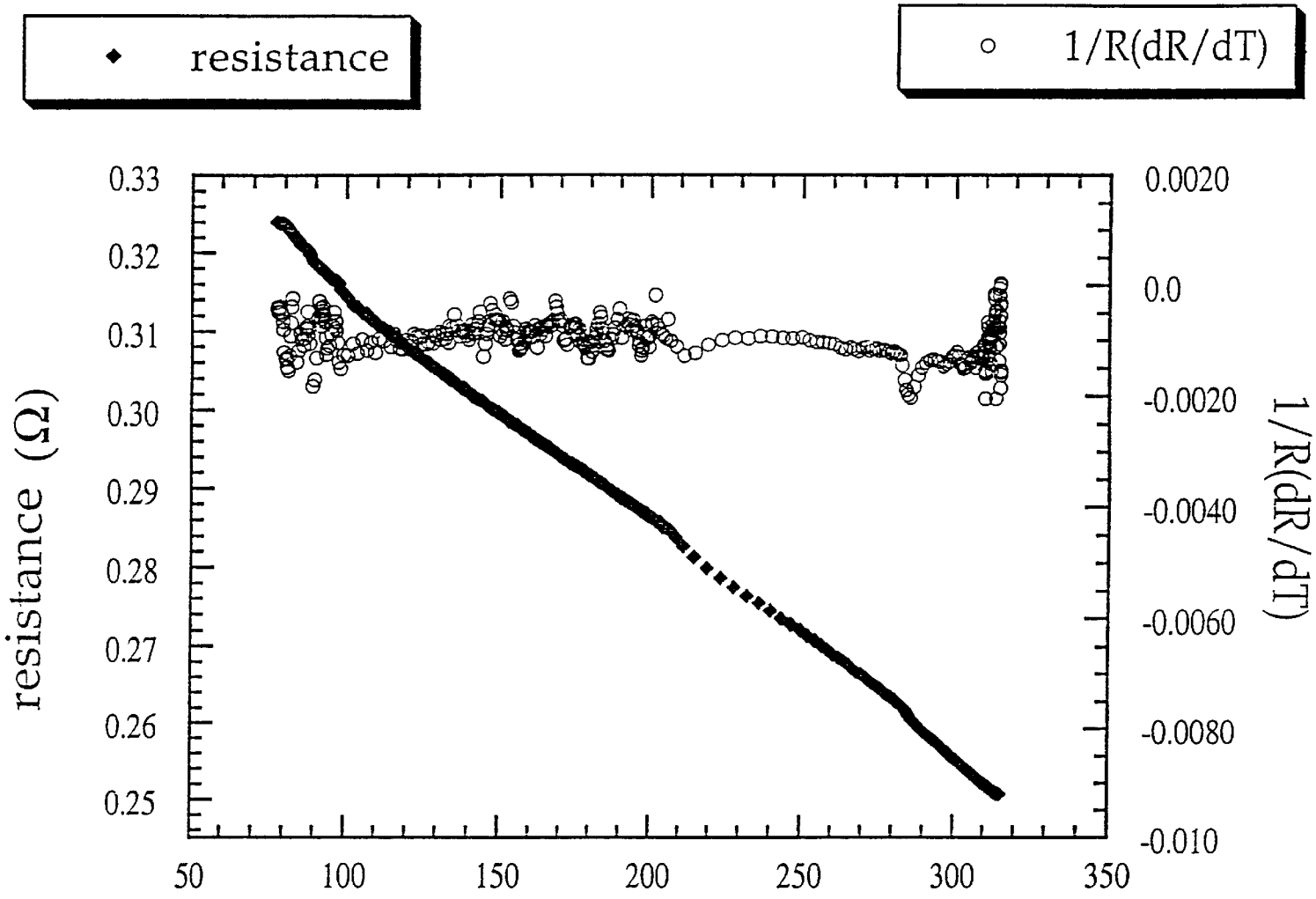

In another embodiment of the present invention, composites of cobalt-ruthenate compounds and glass are provided having a temperature coefficient of resistivity, i.e., $\alpha_{composite}$, which is negative in the entire temperature range between about 77° K. to 300° K. These composites are useful as NTC-thermistors. In one variant of this embodiment of the invention, high resistance NTC-thermistors are provided, the resistivity at room temperature of which is preferably higher than 2 ohm·cm. A glass effective in producing high resistance NTC-thermistors is in particular Microscope Corning glass, since composites comprising said glass and single phase $Co_{2.25}Ru_{0.75}O_4$ as the active phase have electrical resistivities which preferably range, at room temperature, between 10 to 1000 ohm·cm, and most preferably between about 15 to about 750 ohm·cm. The glass contents in the composite preferably varies between 10% to 30% by weight, the electrical resistivity of the composite being proportional to the glass contents, i.e., the higher the contents of the glass, the higher the resistivity. FIG. 16 is an illustration of the resistance as a function of temperature, for a glass composite of $Co_{2.25}Ru_{0.75}O_4$ and the glass designated as glass C. in table I (40 weight percent).

In another variant of the above embodiment, composites of cobalt-ruthenate compounds and glass are provided which are NTC-thermistors the resistivity of which at room temperature is typically between 0.1 to 5 ohm·cm.

The present invention also provides thick film paste composition comprising, as the active phase, cobalt ruthenate compounds of the formula $Co_{3-x}Ru_{x-y}M_yO_4$ wherein:

M is a metal selected from among Mn, Fe, Cu, Zn and Al; and x and y are numbers in the range between 0 and 2, inclusive, and preferably, are independently equal to n·0.25, n being an integer selected from 0 to 7, inclusive; together with a glass and an organic vehicle.

Most preferred are thick film compositions comprising, as the active materials, cobalt-ruthenate compounds of the formula $Co_{3-x}Ru_{x-y}M_yO_4$ wherein x and y are as defined hereinabove, wherein n is an integer selected from 0 to 6 and M is Mn, Fe or Cu, which are single phase, in particular single phase cobalt-ruthenate compounds selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$;

together with glasses and organic vehicle.

In addition to the active phase, the thick film compositions comprise glasses, in particular glasses detailed hereinabove, and a vehicle. Any inert liquid, such as various organic liquids, with or without thickening and or stabilizing agents and or other common additives, may be used as the vehicle. Suitable organic liquids are aliphatic alcohols or esters thereof, terpens such as pine oil, terpineol and the like, solutions of resins such as the polymethylacrylates of lower alcohols and solutions of ethyl cellulose in solvents such as pine oil and the monobutyl ether of ethylene glycol monoacetate. Preferred vehicles are ethyl cellulose solutions in terpineol and butyl ethers of ethylene glycol and soya lecithin.

The ratio of vehicle to solids (the solids hereinafter refer to the active phase and the glass) may vary significantly in order to render the viscosity of the composition in the desirable range. Preferably, the aggregate weight of solids constitutes between 60 to 90% by weight of the composition, and the weight of the vehicle is between 40% to 10%, most preferred is a ratio of about 70% solids and 30% vehicle. The compositions are prepared by methods well known in the art. In general, the particulate inorganic solids are mixed with the organic carrier and dispersed with suitable equipment, such as a three-roll mill, to form a suspension, resulting in a composition for which the viscosity will be in the range of about 100–150 pascalseconds at a shear rate of 4 $s^{-1}$.

The following examples are given for the purpose of illustration and are not intended to limit the scope of the invention.

Preparation I

Preparation of cobalt ruthenate compounds

Starting materials in the proportions indicated in Table III hereinbelow were ground together in an agate mortar, using ethanol to facilitate the grinding. Upon evaporation of the ethanol, the mixture was introduced into a platinum crucible, which was heated in a Lindberg furnace to a peak temperature indicated in Table III as $T_1$, and was kept in the furnace, at said peak temperature, for a period of time indicated in Table III as $\Delta t_1$. The cooldown of the crucible was carried out in the furnace, although in some cases the crucible was taken out of the furnace and was allowed to cool at room temperature. The formation of spinel single phase was determined according to the X-ray diffractogram of the sample. In the event that single phase was not observed, the sample was ground again and heated to a peak temperature indicated in Table III as $T_2$, and was kept in the furnace, at said peak temperature, for a period of time indicated in Table III as $\Delta t_2$.

TABLE III

| Sample Number and Compound | Ingredients | % weight | Sintering Cycle (first) | | Sintering Cycle (second) | |
|---|---|---|---|---|---|---|
| Formula | I, II, III | I:II:III | $T_1$(° C.) | $\Delta t_1$(h) | $T_2$(° C.) | $\Delta t_2$(h) |
| 1-$Co_2RuO_4$ | $RuO_2$, $Co(OH)_2$ | 41.60:58.40 | 924 | 16 | | |
| 2-$Co_{2.25}Ru_{0.75}O_4$ | $RuO_2$, $Co(OH)_2$ | 32.19:67.81 | 925 | 16 | | |
| **3-$Co_{2.25}Ru_{0.75}O_4$** | $RuO_2$, $Co(OH)_2$ | 32.19:67.81 | 925 | 16 | 1023 | 20.5 |
| 4-$Co_{1.75}Ru_{0.75}Mn_{0.5}O_4$ | $RuO_2$, $Co(OH)_2$, $Mn_{O2}$ | 32.63:53.16:14.21 | 960 | 16 | | |
| 5-$Co_{1.75}Ru_{0.75}Mn_{0.5}O_4$ | $RuO_2$, $Co(OH)_2$, $Mn_{O2}$ | 32.63:53.16:14.21 | 960 | 16 | 1100 | 16.25 |
| 6-$Co_{1.75}Ru_{0.75}Fe_{0.5}O_4$ | $RuO_2$, $Co(OH)_2$, $Fe_2O_3$ | 33.01:53.79:13.20 | 960 | 16 | | |
| 7-$Co_{1.75}Ru_{0.75}Fe_{0.5}O_4$ | $RuO_2$, $Co(OH)_2$, $Fe_2O_3$ | 33.01:53.79:13.20 | 960 | 16 | 1100 | 16.25 |
| **8-$Co_2Ru_{0.75}Mu_{0.25}O_4$** | $RuO_2$, $Co(OH)_2$, $MnO_2$ | 32.47:60.46:7.07 | 1108 | 17 | | |
| **9-$Co_2Ru_{0.75}Fe_{0.25}O_4$** | $RuO_2$, $Co(OH)_2$, $Fe_2O_3$ | 32.98:61.42:5.60 | 1108 | 17 | | |
| 10-$Co_2Ru_{0.75}Zn_{0.25}O_4$ | $RuO_2$, $Co(OH)_2$, ZnO | 32.61:60.74:6.65 | 1108 | 16 | | |
| **11-$Co_2Ru_{0.75}Cu_{0.25}O_4$** | $RuO_2$, $Co(OH)_2$, $Cu(Ac)_2$ | 29.74:55.39:14.87 | 1107 | 16 | | |
| 12-$Co_{1.75}Ru_{0.75}Cu_{0.5}O_4$ | $RuO_2$, $Co(OH)_2$, $Cu(Ac)_2$ | 27.55:44.90:27.55 | 1107 | 18.5 | | |
| 13-$Co_{1.5}Ru_{0.75}Cu_{0.75}O_4$ | $RuO_2$, $Co(OH)_2$, $Cu(Ac)_2$ | 25.67:35.85:38.49 | 1107 | 18.5 | | |
| **14-$Co_{1.75}Ru_{0.75}Cu_{0.5}O_4$** | $RuO_2$, $Co(OH)_2$, $Cu(Ac)_2$ | 27.55:44.90:27.55 | 1107 | 18.5 | 1105 | 5 |
| **15-$Co_{1.5}Ru_{0.75}Cu_{0.75}O_4$** | $RuO_2$, $Co(OH)_2$, $Cu(Ac)_2$ | 25.67:35.85:38.49 | 1107 | 18.5 | 1105 | 5 |
| 16-$Co_{1.25}Ru_{0.75}CuO_4$ | $RuO_2$, $Co(OH)_2$, $Cu(Ac)_2$ | 24.02:27.96:48.02 | 1103 | 17 | | |
| 17-$Co_{1.25}Ru_{0.75}CuO_4$ | $RuO_2$, $Co(OH)_2$, $Cu(Ac)_2$ | 24.02:27.96:48.02 | 1101 | 17 | 1101 | 17 |
| 18-$Co_2Ru_{0.75}Al_{0.25}O_4$ | $RuO_2$, $Co(OH)_2$, $CoAl_2O_4$ | 33.70:58.83:7.47 | 1100 | 16 | | |
| 19-$Co_2Ru_{0.75}Al_{0.2504}$ | $RuO_2$, $Co(OH)_2$, $CoAl_2O_4$ | 33.70:58.83:7.47 | 1100 | 16 | 1100 | 15 |
| 20-$Co_{1.75}Ru_{0.75}Al_{0.5}O_4$ | $RuO_2$, $Co(OH)_2$, $CoAl_2O_4$ | 35.21:49.18:15.61 | 1100 | 16 | | |
| 21-$Co_{1.75}Ru_{0.75}Al_{0.5}O_4$ | $RuO_2$, $Co(OH)_2$, $CoAl_2O_4$ | 35.21:49.18:15.61 | 1100 | 16 | 1100 | 15 |
| 22-$Co_{2.5}Ru_{0.5}O_4$ | $RuO_2$, $Co_3O_4$ | 24.90:75.10 | 1050 | 16 | | |
| 23-$Co_{2.5}Ru_{0.5}O_4$ | $RuO_2$, $Co_3O_4$ | 24.90:75.10 | 1050 | 16 | 1100 | 15 |
| 24-$Co_{2.75}Ru_{0.25}O_4$ | $RuO_2$, $Co_3O_4$ | 13.10:86.90 | 1050 | 16 | | |
| 25-$Co_{2.75}Ru_{0.75}O_4$ | $RuO_2$, $Co_3O_4$ | 13.10:86.90 | 1050 | 16 | 1100 | 15 |
| 26-$Co_{2.5}Ru_{0.5}O_4$ | $RuO_2$, $Co(OH)_2$ | 22.26:77.74 | 996 | 16 | | |
| 27-$Co_{2.5}Ru_{0.5}O_4$ | $RuO_2$, $Co(OH)_2$ | 22.26:77.74 | 996 | 16 | 1100 | 16 |
| 28-$Co_{2.75}Ru_{0.25}O_4$ | $RuO_2$, $Co(OH)_2$ | 11.52:88.48 | 996 | 16 | | |
| 29-$Co_{2.75}Ru_{0.25}O_4$ | $RuO_2$, $Co(OH)_2$ | 11.52:88.48 | 996 | 16 | 1100 | 16 |
| **30-$Co_{2.1}Ru_{0.75}Cu_{0.15}O_4$** | 3, 11 | | 1000 | 14 | | |
| **31-$Co_{2.15}Ru_{0.75}Cu_{0.1}O_4$** | 3, 11 | | 1000 | 14 | | |
| **32-$Co_{2.2}Ru_{0.75}Cu_{0.05}O_4$** | 3, 11 | | 1000 | 14 | | |

*compounds, numbers of which are 3, 8, 9, 11, 14, 15, 30, 31 and 32 indicated in bold letters, are compounds which are single phase.

*$Cu(Ac)_2$ is $Cu(Ac)2_2.H_2O$

*compounds 30, 31 and 32 are prepared by reacting final compounds 3 and 11 in appropriate stoichiometric molar ratio.

EXAMPLE 1

Electrical Properties of Single Phase Cobalt Ruthenate Materials

Sintered Pellets of the Single Phase Cobalt Ruthenate Materials Obtained According to Example 1 were Prepared as Follows A pressure of about 5000 kg/cm$^2$ was applied on a dry powder obtained upon grounding the cobalt ruthenate compound in agate mortar in the presence of a 3% solution of polyvinyl alcohol in ethanol. The pressed pellets were typically sintered in a furnace at temperatures of about 1000–1100° C., supported in a platinum dish (specific sinterizations are indicated, when required, in table IV). The geometrical parameters and the weight of each pellet are also given in table IV.

The Electrical Contacts Were Made as Follows

Two opposite faces of the pellet were coated with Ag to provide electrodes thereon, and subsequently, the pellets were heated for about 20 minuets in a furnace at a temperature of about 850° C. The pellets were then cooled to room temperature, and copper wires were soldered to the Ag coated face.

The Electrical Measurements Were Conducted in the Following Manner

The test substrates were electrically connected to a digital ohm-meter (A two-wire four-terminal input milliohm meter—MO-2001 manufactured by EXTECH—was applied for low resistances measurements, while a two-probe digital ohmmeter—Fluke 8502—was applied for high resistances. The resistance of the substrate was measured and recorded, typically for three or four pellets of the same substrate, at three different temperatures:

at 77 K. (±1 deg), designated as $T_1$ in Table IV;

at 291 K. (±1 deg), designated as $T_2$ in Table IV; and at a temperature between 373 K. to 384 K. (±5 deg), designated as $T_3$ in Table IV.

The resistance of each pellet at each of the temperatures $T_1$, $T_2$ and $T_3$ is given in Table IV, where the resistances are referred to as $R_1$, $R_2$ and $R_3$, respectively. Table IV also summarizes the sintering data of the pellets prepared. The notation used in the tables to designate the pellets is as follows: P#(α,β,γ, . . .), wherein # is the number of the sample of the active material, taken from Table III, which was used to prepare the pellet and the Greek letter in the parentheses is used to enumerate pellets of the same compositions.

TABLE IV

| | | Pellet dimensions and weight after sintering | | | Electrical Measurements Resistance (ohm) | | |
|---|---|---|---|---|---|---|---|
| Pellet | | Diameter (mm) | Height (mm) | Weight (g) | $R_1$ | $R_2$ | $R_3$ |
| P-3: | P-3(α) | 6.06 | 4.90 | 0.5196 | — | — | — |
| | P-3(β) | 6.02 | 4.96 | 0.5427 | $1.61 \times 10^8$ | 112.2 | 9.1* |
| | P-3(γ) | 6.02 | 4.52 | 0.4837 | $1.57 \times 10^8$ | 70.7 | 7.17* |
| | P-3(δ) | 6.02 | 5.26 | 0.5588 | $1.58 \times 10^8$ | 78.0 | 8.15* |
| P-8: | P-8(α) | 6.06 | 1.5 | 0.1497 | $1.41 \times 10^8$ | 7.28 | 0.95 |
| | P-8(β) | 6.02 | 2.58 | 0.2569 | $1.53 \times 10^8$ | 15.34 | 1.98 |
| | P-8(γ) | 6.08 | 4.2 | 0.4402 | $2.28 \times 10^8$ | 19.57 | 2.28* |
| | P-8(δ) | 6.04 | 2.86 | 0.2933 | $1.97 \times 10^8$ | 14.58 | 1.73 |
| P-9: | P-9(α) | 6.06 | 5.7 | 0.6808 | $1.56 \times 10^8$ | 26.1 | 3.55* |
| | P-9(β) | 6.04 | 3.36 | 0.3838 | $1.67 \times 10^8$ | 32.6 | 4.13* |
| | P-9(γ) | 6.04 | 3.7 | 0.4224 | $1.19 \times 10^8$ | 19.73 | 2.46* |

TABLE IV-continued

| | | Pellet dimensions and weight after sintering | | | Electrical Measurements Resistance (ohm) | | |
|---|---|---|---|---|---|---|---|
| Pellet | | Diameter (mm) | Height (mm) | Weight (g) | $R_1$ | $R_2$ | $R_3$ |
| P-11: | P-11(α) | 6.0 | 2.74 | 0.2720 | — | — | — |
| | P-11(β) | 6.04 | 2.9 | 0.3055 | — | — | — |
| | P-11(γ) | 6.02 | 2.6 | 0.2763 | 14.4 | 0.263 | 0.185* |
| P-14: | P-14(α) | 6.08 | 1.78 | 0.2178 | 1.013 | 0.140 | 0.122* |
| | P-14(β) | 6.06 | 1.88 | 0.2238 | 1.116 | 0.149 | 0.123* |
| | P-14(γ) | 6.08 | 3.14 | 0.3857 | 1.727 | 0.210 | 0.165* |
| | P-14(δ) | 6.02 | 2.92 | 0.3437 | 2.05 | 0.242 | 0.191* |
| P-15: | P-15(α) | 6.06 | 1.7 | 0.2049 | 0.468 | 0.114 | 0.106* |
| | P-15(β) | 6.08 | 2.0 | 0.2490 | 0.548 | 0.135 | 0.121* |
| | P-15(γ) | 6.08 | 1.84 | 0.2270 | 0.410 | 0.111 | 0.104* |

*$R_3$ was generally measured at 111° C., results indicated by abstrics refer to 105° C.

The Calculation of the Electrical Parameters Characterizing the Substrate is Carried Out as Follows The thermistor constant β is calculated using the following formula, which is easily derived from equation (II), represnting β as the slope of the plot of lnR versus 1/T:

$$\beta=[ln(R_j)-ln(R_i)]/[1/T_j-1/T_j] \quad \text{(IV)}$$

wherein i,j∈{1,2,3) and $T_i$, $T_j$ are the temperatures at which the corresponding resistances $R_i$, $R_j$ were measured. Table V reports the results for the thermistor constant in two temperature ranges : in the range between 77° K. to 291° K. and 291° K. to 384° K. The results referring to each cobalt ruthenate compound were averged on the corresponding pellets comprising said compound.

TABLE V

| compound | β (77° K. to 291° K.) | β (291° K. to 384° K.) |
|---|---|---|
| $Co_{2.25}Ru_{0.75}O_4$ (P-3) | 1511.7 | 2975.1 |
| $Co_2Ru_{0.75}Mn_{0.25}O_4$ (P-8) | 1716.8 | 2541.6 |
| $Co_2Ru_{0.75}Fe_{0.25}O_4$ (P-9) | 1628.7 | 2589.0 |
| $Co_2Ru_{0.75}Cu_{0.25}O_4$ (P-11) | 419.1 | 444.8 |
| $Co_{1.75}Ru_{0.75}Cu_{0.5}O_4$ (P-14) | 215.6 | 255.2 |
| $CO_{1.5}Ru_{0.75}Cu_{0.75}O_4$ (P-15) | 143.8 | 104.3 |

These results show that the single phase cobalt ruthenate materials are useful as NTC-thermistors.

Preparation II

Preparation of Composites of Cobalt-ruthenate Compounds and Glass and Pellets Thereof The composites were prepared by wet grinding of proper proportions of starting materials in an agate mortar. Ethanol and 3–5 drops of 3% PVA in ethanol solution served as the grinding liquid. After evaporation of the ethanol, pellets were pressed from the dry powder by applying a pressure of ~6000 kg/cm$^2$. The majority of the composites were sintered in a box furnace at a peak temperature of 850° C. for ~20 min to simulate thick film processing. Pellets were placed in a Pt crucible during the sintering to prevent interaction of the glassy phase with the support. This process of heating the pellets to 850° C. and maintaining them at 850° C. for 20 min, followed by slow cooling, is referred to as standard heat treatment in Table VI. Composites of Microscope Corning glass were subjected to a peak temperature of 1100° C., for a period of time ranging from 1 to 3 h, as indicated specifically in Table VI.

The notation used for enumerating the composites is GC.–#(X–##), wherein:

# is the number of the sample of the cobalt ruthente compound as indicated in Table III;

X (=A, B, C, D, E or F) identifies the glass according to Table I with the additional letter F standing for a Microscope Corning glass; and ## is the number which designates the specific composite among those made of the same cobalt ruthenate compound and the same glass.

For example: GC-3(B-1) indicates a glass composite constituted of:

cobalt ruthente compound number 3 from table III;

glass B from table I; and number 1 refers to pellet number 1 of said composite (typically about 3 to 5 pellets were prepared from each composition to test reproducibility.

TABLE VI

| Glass composite | Ingredients: Cobalt Ruthenate compound; Glass | % weight Glass | Heat Treatment peak temperature, time |
|---|---|---|---|
| GC-3(F-1) | 3*- $Co_{2.25}Ru_{0.75}O_4$;corning glass | 10 | 1100° C., 2 hours |
| GC-3(F-2) | 3*- $Co_{2.25}Ru_{0.75}O_4$;corning glass | 20 | 1100° C., 1 hour |
| GC-3(F-3) | 3*- $Co_{2.25}Ru_{0.75}O_4$;corning glass | 30 | 1100° C., 1 hour |
| GC-3(F-4) | 3*- $Co_{2.25}Ru_{0.75}O_4$;corning glass | 10 | 1100° C., 1 hour |
| GC-3(F-5) | 3*- $Co_{2.25}Ru_{0.75}O_4$;corning glass | 20 | 1100° C., 1 hour |
| GC-3(F-6) | 3*- $Co_{2.25}Ru_{0.75}O_4$;corning glass | 30 | 1100° C., 1 hour |
| GC-3(B-1) | 3*- $Co_{2.25}Ru_{0.75}O_4$; B | 20 | standard |
| GC-3(B-2) | 3*- $Co_{2.25}Ru_{0.75}O_4$; B | 40 | standard |
| GC-3(C-1) | 3*- $Co_{2.25}Ru_{0.75}O_4$; C | 20 | standard |
| GC-3(C-2) | 3*- $Co_{2.25}Ru_{0.75}O_4$; C | 40 | standard |
| GC-3(D-1) | 3*- $Co_{2.25}Ru_{0.75}O_4$; D | 20 | standard |
| GC-3(D-2) | 3*- $Co_{2.25}Ru_{0.75}O_4$; D | 40 | standard |
| GC-3(A-1) | 3*- $Co_{2.25}Ru_{0.75}O_4$; A | 20 | standard |
| GC-3(A-2) | 3*- $Co_{2.25}Ru_{0.75}O_4$; A | 40 | standard |
| GC-3(E-1) | 3*- $Co_{2.25}Ru_{0.75}O_4$; E | 20 | standard |
| GC-3(E-2) | 3*- $Co_{2.25}Ru_{0.75}O_4$; E | 40 | standard |
| GC-8(B-1) | 8- $Co_2Ru_{0.75}Mn_{0.25}O_4$; B | 20 | standard |
| GC-8(B-2) | 8- $Co_2Ru_{0.75}Mn_{0.25}O_4$; B | 40 | standard |
| GC-8(C-1) | 8- $Co_2Ru_{0.75}Mn_{0.25}O_4$; C | 20 | standard |
| GC-8(C-2) | 8- $Co_2Ru_{0.75}Mn_{0.25}O_4$; C | 40 | standard |
| GC-8(D-1) | 8- $Co_2Ru_{0.75}Mn_{0.25}O_4$; D | 20 | standard |
| GC-8(D-2) | 8- $Co_2Ru_{0.75}Mn_{0.25}O_4$; D | 40 | standard |
| GC-8(A-1) | 8- $Co_2Ru_{0.75}Mn_{0.25}O_4$; A | 20 | standard |
| GC-8(A-2) | 8- $Co_2Ru_{0.75}Mn_{0.25}O_4$; A | 40 | standard |
| GC-8(E-1) | 8- $Co_2Ru_{0.75}Mn_{0.25}O_4$; E | 20 | standard |
| GC-8(E-2) | 8- $Co_2Ru_{0.75}Mn_{0.25}O_4$; E | 40 | standard |
| GC-9(B-1) | 9- $Co_2Ru_{0.75}Fe_{0.25}O_4$; B | 20 | standard |
| GC-9(B-2) | 9- $Co_2Ru_{0.75}Fe_{0.25}O_4$; B | 40 | standard |
| GC-9(C-1) | 9- $Co_2Ru_{0.75}Fe_{0.25}O_4$; C | 20 | standard |
| GC-9(C-2) | 9- $Co_2Ru_{0.75}Fe_{0.25}O_4$; C | 40 | standard |
| GC-9(D-1) | 9- $Co_2Ru_{0.75}Fe_{0.25}O_4$; D | 20 | standard |
| GC-9(A-1) | 9- $Co_2Ru_{0.75}Fe_{0.25}O_4$; A | 20 | standard |
| GC-9(A-2) | 9- $Co_2Ru_{0.75}Fe_{0.25}O_4$; A | 40 | standard |
| GC-9(E-1) | 8- $Co_2Ru_{0.75}Fe_{0.25}O_4$; E | 20 | standard |
| GC-9(E-2) | 8- $Co_2Ru_{0.75}Fe_{0.25}O_4$; E | 40 | standard |
| GC-11(B-1) | 11*- $Co_2Ru_{0.75}Cu_{0.25}O_4$; B | 20 | standard |
| GC-11(B-2) | 11*- $Co_2Ru_{0.75}Cu_{0.25}O_4$; B | 40 | standard |
| GC-11(C-1) | 11*- $Co_2Ru_{0.75}Cu_{0.25}O_4$; C | 20 | standard |
| GC-11(C-2) | 11*- $Co_2Ru_{0.75}Cu_{0.25}O_4$; C | 40 | standard |
| GC-11(D-1) | 11*- $Co_2Ru_{0.75}Cu_{0.25}O_4$; D | 20 | standard |
| GC-11(D-1) | 11*- $Co_2Ru_{0.75}Cu_{0.25}O_4$; D | 40 | standard |
| GC-11(A-1) | 11*- $Co_2Ru_{0.75}Cu_{0.25}O_4$; A | 20 | standard |
| GC-11(A-2) | 11*- $Co_2Ru_{0.75}Cu_{0.25}O_4$; A | 40 | standard |

TABLE VI-continued

| Glass composite | Ingredients: Cobalt Ruthenate compound; Glass | % weight Glass | Heat Treatment peak temperature, time |
|---|---|---|---|
| GC-11(E-1) | 11*- $Co_2Ru_{0.75}Cu_{0.25}O_4$; E | 20 | standard |
| GC-11(E-2) | 11*- $Co_2Ru_{0.75}Cu_{0.25}O_4$; E | 40 | standard |
| GC-14(B-1) | 14*- $Co_{1.75}Ru_{0.75}Cu_{0.25}O_4$; B | 20 | standard |
| GC-14(B-2) | 14*- $Co_{1.75}Ru_{0.75}Cu_{0.5}O_4$; B | 40 | standard |
| GC-14(C-1) | 14*- $Co_{1.75}Ru_{0.75}Cu_{0.5}O_4$; C | 20 | standard |
| GC-14(C-2) | 14*- $Co_{1.75}Ru_{0.75}Cu_{0.5}O_4$; C | 40 | standard |
| GC-14(D-1) | 14*- $Co_{1.75}Ru_{0.75}Cu_{0.5}O_4$; D | 20 | standard |
| GC-14(D-1) | 14*- $Co_{1.75}Ru_{0.75}Cu_{0.5}O_4$; D | 40 | standard |
| GC-14(A-1) | 14*- $Co_{1.75}Ru_{0.75}Cu_{0.5}O_4$; A | 20 | standard |
| GC-14(A-2) | 14*- $Co_{1.75}Ru_{0.75}Cu_{0.5}O_4$; A | 40 | standard |
| GC-14(E-1) | 14*- $Co_{1.75}Ru_{0.75}Cu_{0.5}O_4$; E | 20 | standard |
| GC-14(E-2) | 14*- $Co_{1.75}Ru_{0.75}Cu_{0.5}O_4$; B | 40 | standard |
| GC-15(B-1) | 15- $Co_{1.5}Ru_{0.75}Cu_{0.75}O_4$; B | 20 | standard |
| GC-15(B-2) | 15- $Co_{1.5}Ru_{0.75}Cu_{0.75}O_4$; B | 40 | standard |
| GC-15(C-1) | 15- $Co_{1.5}Ru_{0.75}Cu_{0.75}O_4$; C | 20 | standard |
| GC-15(C-2) | 15- $Co_{1.5}Ru_{0.75}Cu_{0.75}O_4$; C | 40 | standard |
| GC-15(D-1) | 15- $Co_{1.5}Ru_{0.75}Cu_{0.75}O_4$; D | 20 | standard |
| GC-15(D-1) | 15- $Co_{1.5}Ru_{0.75}Cu_{0.75}O_4$; D | 40 | standard |
| GC-17(B-1) | 17- $Co_{1.25}Ru_{0.75}Cu_{O4}$; B | 20 | standard |
| GC-17(B-2) | 17- $Co_{1.25}Ru_{0.75}Cu_{O4}$; B | 40 | standard |
| GC-17(C-1) | 17- $Co_{1.25}Ru_{0.75}Cu_{O4}$; C | 20 | standard |
| GC-17(C-2) | 17- $Co_{1.25}Ru_{0.75}Cu_{O4}$; C | 40 | standard |
| GC-17(D-1) | 17- $Co_{1.25}Ru_{0.75}Cu_{O4}$; D | 20 | standard |
| GC-17(D-1) | 17- $Co_{1.25}Ru_{0.75}Cu_{O4}$; D | 40 | standard |
| GC-17(A-1) | 17- $Co_{1.25}Ru_{0.75}Cu_{O4}$; A | 20 | standard |
| GC-17(A-2) | 17- $Co_{1.25}Ru_{0.75}Cu_{O4}$; A | 40 | standard |
| GC-17(E-1) | 17- $Co_{1.25}Ru_{0.75}Cu_{O4}$; E | 20 | standard |
| GC-17(E-2) | 17- $Co_{1.25}Ru_{0.75}Cu_{O4}$; E | 40 | standard |

*and other lots of the same cobalt ruthenate material.

EXAMPLE 2

Electrical Properties of the Composites of Cobalt-ruthenate Compounds and Glass Electrical measurements were performed in the same manner as detailed in Example 1, with the difference that additional measurements were made at temperatures around −55° C(±1deg); this was achieved by using acetone-liquid nitrogen. The pellets were coated with 5007 Ag and 6160 Ag (Du Pont's commercial products). Table VII summarizes the measurments of the electrical properties of the composites of cobalt-ruthenate compounds and glass, by detailing the the sign of $\alpha_{composite}$ and, for some of the composites, the resistivities at room temperature which were calculated from the resistances measured for the pellets, taking into account the geometry of the pellets. Where, for a given composite several resistivities are indicated in the table, these referr to several measurements carried out on different pellets of the same composite.

TABLE VII

| composite | Resistivity at room temperature (ohm·cm) | $\alpha_{composite}$ |
|---|---|---|
| GC-3(F-1) | 38.3, 40.9, 39.3, 54.7 | negative |
| GC-3(F-2) | 374.9, 394.9 | negative |
| GC-3(F-3) | 450.0, 731.6, 575.7 | negative |
| GC-3(F-4) | 15.82, 15.1, 14.9 | negative |
| GC-3(F-5) | 217.2, 272.3 | negative |
| GC-3(B-1) | 0.0964 | varies sign |
| GC-3(B-2) | 2056.1, 835.7 | negative |
| GC-3(C-1) | 0.34 | negative |
| GC-3(C-2) | 0.20 | positive (W) |
| GC-3(D-2) | 0.28 | positive |
| GC-3(E-1) | 0.22 | positive |
| GC-3(E-2) | 0.15 | positive |

TABLE VII-continued

| composite | Resistivity at room temperature (ohm·cm) | $\alpha_{composite}$ |
|---|---|---|
| GC-3(E-2) | 0.71 | positive |
| GC-8(B-1) | 27.30 | negative |
| GC-8(B-2) | 136.44 | negative |
| GC-8(C-1) | 0.76 | negative |
| GC-8(C-2) | 0.15 | positive |
| GC-8(D-1) | 8.11 | negative |
| GC-8(D-2) | 14.56 | negative |
| GC-8(A-1) | 0.90 | negative |
| GC-8(A-2) | 0.20 | positive |
| GC-8(E-1) | 0.24 | positive |
| GC-9(B-1) | 110.8 | negative |
| GC-9(B-2) | 1820.5 | negative |
| GC-9(C-1) | 0.61 | negative |
| GC-9(C-2) | 0.18 | positive (W) |
| GC-9(D-1) | 22.32 | negative |
| GC-9(D-2) | 193.42 | negative |
| GC-9(A-1) | 0.28 | negative |
| GC-9(A-1) | 0.76 | negative |
| GC-9(E-1) | 0.24 | positive (W) |
| GC-11(B-1) | — | negative |
| GC-11(B-2) | — | negative |
| GC-11(C-1) | — | positive |
| GC-11(C-2) | — | positive |
| GC-11(D-1) | — | negative |
| GC-11(D-1) | — | negative |
| GC-11(A-1) | — | positive |
| GC-11(A-2) | — | positive |
| GC-14(B-1) | — | negative |
| GC-14(B-2) | — | positive (W) |
| GC-14(C-1) | — | positive |
| GC-14(C-2) | — | positive (W) |
| GC-14(D-1) | — | negative |
| GC-14(D-1) | — | negative |
| GC-14(A-1) | — | positive (W) |
| GC-14(A-2) | — | negative |
| GC-15(B-1) | — | positive |
| GC-15(B-2) | — | positive |
| GC-15(C-1) | — | positive |
| GC-15(C-2) | — | negative |
| GC-15(D-1) | — | negative |
| GC-15(D-1) | — | negative |
| GC-17(B-1) | — | positive |
| GC-17(B-2) | — | positive |
| GC-17(C-1) | — | positive |
| GC-17(C-2) | — | positive |
| GC-17(D-1) | — | negative |
| GC-17(D-1) | — | negative |
| GC-17(A-1) | — | negative |

1) positive (w) refers to small, positive $\alpha_{composite}$

The results illustrate the broad spectrum of electrical properties of the composites of cobalt-ruthenate compounds and glass according to the present invention. By appropriately choosing the active cobalt ruthenate compound and the glass, and by controlling their ratio, as illustrated in the table, it is possible to produce composites for a variety of uses, according to their electrical properties.

Preparation III

Preparation of Thick Film Formulations

In the following examples, the formulation was carried out in the following manner:

The organics used were ethyl cellulose solutions in terpineol and butyl ethers of ethylene glycol and soya lecithin. The solid inorganics (detailed in table VIII below) and the organics, minus about 5% weight of the organic component are weighed together in a container. The components are then vigorously mixed to form a uniform blend; then the blend is passed through dispersing equipment, such as a three roll mill, to achieve good dispersion of particles. A Hegman gauge is used to determine the state of dispersion of the particles in the paste. The instrument consists of a channel in a block of steel that is 25 $\mu$m deep (1 mil) on one end and ramps up to 0" depth at the other end. A blade is used to draw down paste along the length of the channel. Scratches will appear in the channel where the agglomerates' diameter is greater than the channel depth. A satisfactory dispersion will give a fourth scratch point of 10–18 typically. The point at which half the channel is uncovered with a well dispersed paste is between 3 and 8 typically. Fourth scratch measurement of >20 $\mu$m and "half channel" measurements of >10 $\mu$m indicate a poorly dispersed suspension.

The remaining 5% consisting of organic components of the paste is then added, and the resin content is adjusted to bring the viscosity when fully formulated to between 140 and 200 Pascal seconds at a shear rate of 4 $sec^{-1}$. The composition is then applied to a substrate, such as alumina ceramic, usually by the process of screen printing, to a wet thickness of about 3–80 microns, preferably 35–70 microns, and most preferably 40–50 microns. The electrode compositions of this invention can be printed onto the substrates either by using an automatic printer or a hand printer in the conventional manner, preferably automatic screen stencil techniques are employed using a 200 to 325 mesh screen. The printed pattern is then dried at below 200° C., about 150° C., for about 5–15 minutes before firing. Firing to effect sintering of both the inorganic binder and the finely divided particles of metal is preferably done in a well ventilated belt conveyor furnace with a temperature profile that will allow burnout of the organic matter at about 300–600° C., a period of maximum temperature or about 800–950° C. lasting about 5–15 minutes, followed by a controlled cooldown cycle to prevent over-sintering, unwanted chemical reactions at intermediate temperatures or substrate fracture which can occur from too rapid cooldown. The overall firing procedure will preferably extend over a period of about 1 hour, with 20–25 minutes to reach the firing temperature, about 10 minutes at the firing temperature, and about 20–25 minutes in cooldown. In some instances, totally cycle times as short as 30 minutes can be used.

The following table detail the composition of some thick film formulations according to the present invention. The numbers in the table are given in weight percent. TFF is an abbreviation for Thick Film Formulation.

TABLE VIII

| ingredients → code ↓ | active material: $Co_{2.25}Ru_{0.75}O_4$ | glass: B | Glass: A | Organics |
|---|---|---|---|---|
| TFF-1 | 66.5 | 3.5 | | 30 |
| TFF-2 | 63.0 | 7.0 | | 30 |
| TFF-3 | 59.5 | 10.5 | | 30 |
| TFF-4 | 56.0 | 14.0 | | 30 |
| TFF-5 | 52.5 | 17.5 | | 30 |
| TFF-6 | 49.0 | 21.0 | | 30 |
| TFF-7 | 45.5 | 24.5 | | 30 |
| TFF-8 | 66.5 | | 3.5 | 30 |
| TFF-9 | 63.0 | | 7.0 | 30 |
| TFF-10 | 59.5 | | 10.5 | 30 |
| TFF-11 | 56.0 | | 14.0 | 30 |
| TFF-12 | 52.5 | | 17.5 | 30 |
| TFF-13 | 49.0 | | 21.0 | 30 |
| TFF-14 | 45.5 | | 24.5 | 30 |

EXAMPLE III

Electrical Properties of Thick Film Compositions

The above formulations were used to prepare samples to be tested for temperature coefficient of resistance, hereinafter designated as $\alpha_{tff}$.

The Samples Were Prepared as Follows

A pattern of the formulation to be tested is screen printed upon each of ten coded Alsimag 614 1 ×1" ceramic substrates, and allowed to equilibrate at room temperature and then dried at 150° C. The mean thickness of each set of dried films before firing must be 22–28 microns as measured by a Brush Surfanalyzer. The dried and printed substrate is then fired for about 60 minutes using a cycle of heating at 35° C. per minute to 850° C., dwell at 850° C. for 9 to 10 minutes and cooled at a rate of 30° C. per minute to adhesion temperature.

Resistance Measurement and Calculations are Carried Out as Follows

The test substrates are mounted on terminal posts with a controlled temperature chamber and electrically connected to a digital ohm-meter. The temperature in the chamber is adjusted to 25° C. and allowed to equilibrate after which the resistance of each substrate is measured and recorded.

The temperature of the chamber is then raised to 125° C. and allowed to equilibrate, after which the resistance of the substrate is again measured and recorded.

The temperature of the chamber is then cooled to −55° C. and allowed to equilibrate and the cold resistance measured and recorded.

For the purpose of estimating the temperature coefficient of resistance in the temperature ranges between 25° C. and 125° C. and between −55° C. and 25° C., hereinafter designated as $\alpha_{tff,\,hot}$ and $\alpha_{tff,\,cold}$, respectively, the definition given in formula I is approximated by the following linear approximation:

$$\alpha_{iff,hot} = \frac{1}{R_{T=25°C.}} \frac{R_{T=125°C.} - R_{T=25°C.}}{125 - 25} 10^6 \text{ppm/°C.} \quad \text{(V)}$$

$$\alpha_{iff,cold} = \frac{1}{R_{T=25°C.}} \frac{R_{T=-55°C.} - R_{T=25°C.}}{-55 - 25} 10^6 \text{ppm/°C.} \quad \text{(VI)}$$

The values of $R_{T=25°\,C.}$ and of $\alpha_{tff,\,hot}$ and $\alpha_{tff,\,cold}$, are averaged and $R_{T=25°\,C.}$ values are normalized to 25 microns dry printed thickness and resistivity is reported as ohms per square at 25 microns dry print thickness. Normalization of the multiple test values is calculated with the following relationship:

$$\text{Normalized Resistance} = \frac{\text{Averaged Measured Resistance} \times \text{Averaged dry print thickness, microns}}{25 \text{ microns}}$$

The results are given in the following table (the term refired indicates that the printed substrate was subjected to a subsequent firing cycle).

TABLE IX

| properties → | (As Fired) electrical parameters | | | (Refired) electrical parameters | | |
|---|---|---|---|---|---|---|
| code ↓ | R MΩ/□/mil | $\alpha_{tff,hot}$ ppm/° C. | $\alpha_{tff,cold}$ ppm/° C. | R MΩ/□/mil | $\alpha_{tff,hot}$ ppm/° C. | $\alpha_{tff,cold}$ ppm/° C. |
| TFF-1 | 0.7999 | −9471 | −336000 | 1.454 | −9487 | −234000 |
| TFF-2 | 1.607 | −9443 | * | 3.110 | −9403 | * |
| TFF-3 | 2.092 | −9396 | * | 3.430 | −9395 | * |
| TFF-4 | 2.509 | −9375 | * | 3.321 | −9357 | * |
| TFF-5 | 2.804 | −9357 | * | 3.196 | −9301 | * |
| TFF-6 | 2.907 | −9318 | * | 2.723 | −9282 | * |
| TFF-7 | 3.407 | −9342 | * | 1.744 | −9233 | * |
| TFF-8 | 0.463 | −9498 | −386000 | 0.580 | −9538 | −378000 |
| TFF-9 | 0.660 | −9451 | −369000 | 1.062 | −9506 | −322000 |
| TFF-10 | 0.578 | −9410 | −357000 | 0.674 | −9445 | −368000 |
| TFF-11 | 0.336 | −9327 | −422000 | 0.380 | −9350 | −330000 |
| TFF-12 | 0.217 | −9261 | −297000 | 0.167 | −9226 | −289000 |
| TFF-13 | 0.164 | −9210 | −267000 | 0.061 | −9019 | −223000 |
| TFF-14 | 0.222 | −9322 | −505000 | 0.097 | −9147 | −228000 |

*resistance could not be determined by the TCR-chamber used.

As evidenced from the table, the present invention provides thick film formulations wherein the absolute values of $\alpha_{tff,\,hot}$ and $\alpha_{tff,\,cold}$ are higher than known in the art.

All the above description and examples have been provided for the purpose of illsutartion, and are not intended to limit the invention in any way. Various modifications can be carried out in the system according to the invention, without departing from its spirit.

I claim:

1. Composition of matter of cobalt ruthenate compounds and glass, wherein said compounds have the formula: $Co_{3-x}Ru_{x-y}M_yO_4$, wherein M comprises a metal selected from the group consisting of Mn, Fe, Cu, Zn and Al; and x and y are numbers in the range between 0 and 2, inclusive, provided that the value of x−y is greater than 0, and when x is 1, y is not 0, thereby excluding the compound $Co_2RuO_4$.

2. Composition of matter of cobalt ruthenate compounds and glass according to claim 1, said cobalt ruthenate compounds having the formula $Co_{3-x}Ru_{x-y}M_yO_4$, wherein:

M comprises a metal selected from the group consisting of Mn, Fe, Cu, Zn and Al; and x and y independently are equal to n·0.25, n being an integer selected from 0 to 7, inclusive.

3. Composition of matter of cobalt ruthenate compounds and glass according to claim 2, wherein n is an integer selected from 0 to 6 and M is Mn, Fe or Cu, and the cobalt ruthenate compounds are single phase materials as hereinbefore defined.

4. Composition of matter of cobalt ruthenate compounds and glass according to claim 3, wherein the cobalt ruthenate compounds are selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$.

5. Composition of matter according to claim 1, wherein the glass is a Microscope Corning glass.

6. Composition of matter according to claim 1, wherein the glasses are Pb or Bi-containing glasses.

7. Composition of matter according to claim 6, wherein the glass comprises about 10 to 60 mole percent silica and about 5 to 70 mole percent oxides of Pb or Bi or mixtures thereof.

8. Composition of matter according to claim 7, wherein the glass further comprises transition metal oxides, the atomic numbers of said transition metals being between 22 to 30, exclusive.

9. Composition of matter according to claim 8, wherein the transition metals present in the glasses are Co, Fe, Zn, Mn or mixtures thereof.

10. Composition of matter according to claim 7, wherein the glass further comprises glass forming oxides and/or conditional glass forming oxides.

11. Composition of matter according to claim 7, wherein the glass forming oxides and/or conditional glass forming oxides present in the glasses are selected from the group consisting of $TiO_2$, $Al_2O_3$, $B_2O_3$ and $ZrO_2$.

12. Composition of matter according to claim 1, wherein the amount of glass varies between about 5% to about 80% of the total weight of the composite.

13. Composition of matter according to claim 1 having a temperature coefficient of resistivity $\alpha_{composite}$ which is positive in at least a portion of the temperature range between about 77° K. to 300° K., said $\alpha_{composite}$ being temperature dependent or substantially constant in said temperature range.

14. Composition of matter according to claim 13, wherein $\alpha_{composite}$ is positive throughout the entire temperature range between about 77° K. to 300° K., the resistivity of the composite being a substantially non-linear, increasing monotonic function of temperature in said range.

15. Composition of matter according to claim 13, wherein $\alpha_{composite}$ is temperature dependent, being positive in at least one portion of the range between about 77° K. to 300° K. and negative in a complementary portion, the resistivity being a non-monotonic function of the temperature in the range between about 77° K. to 300° K.

16. Composition of matter according to claim 13, wherein $\alpha_{composite}$ is positive throughout the range between about from 77° K. to 300° K. and is not temperature dependent, said $\alpha_{composite}$ having an approximately constant value in said range, the resistivity of the composite being a substantially increasing, linear function of temperature.

17. Composition of matter according to claim 1, wherein $\alpha_{composite}$ is negative throughout the temperature range between 77° K. to 300° K.

18. Composition of matter according to claim 14, wherein $\alpha_{composite}$ reaches values in the range of about 2500 to 8000 ppm/deg at room temperature.

19. Composition of matter according to claim 18, wherein $\alpha_{composite}$ reaches values in the range about 5000 to 7000 ppm/deg at room temperature, said composites having, at said temperature, resistivity lower than 5 ohm·cm.

20. Composition of matter according to claim 19, wherein said composites having, at said temperature, resistivity lower than lower than 0.3 ohm·cm.

21. Composition of matter according to claim 16, wherein $\alpha_{composite}$ is substantially constant in the temperature range between about 77° K. to 300° K., the value of which being in the range between 1000 to 4000 ppm/deg.

22. Composition of matter according to claim 16, wherein $\alpha_{composite}$ is substantially constant in the temperature range between about 77° K. to 300° K., the value of which is between about few tens to 500 ppm/deg, wherein said composites having, at ambient temperature, electrical resistivity lower than 0.25 ohm·cm.

23. Composition of matter according to claim 15, wherein $\alpha_{composite}$ is very strongly temperature dependent as hereinbefore defined at a partial temperature range in the portion of the temperature range of between about 77° K. to 300° K. at which $\alpha_{composite}$ is positive.

24. Composition of matter according to claim 23, wherein said partial range is in the vicinity of 80° K.

25. A thick film paste composition, comprising: active compounds of the formula $Co_{3-x}Ru_{x-y}M_yO_4$, wherein M comprises a metal selected from the group consisting of Mn, Fe, Cu, Zn and Al; and x and y are numbers in the range between 0 and 2, inclusive, provided that the value of x−y is greater than 0, and when x is 1, y is not 0, thereby excluding the compound $Co_2RuO_4$; glass; and organic medium.

26. A thick film paste composition according to claim 24 wherein the cobalt ruthenate compounds are of the formula $Co_{3-x}Ru_{x-y}M_yO_4$ wherein:

M is a metal selected from the group consisting of Mn, Fe, Cu, Zn and Al; and x and y independently are equal to n·0.25, n being an integer selected from 0 to 7.

27. A thick film paste composition according to claim 26 wherein the cobalt ruthenate compounds are of the formula $Co_{3-x}Ru_{x-y}M_yO_4$, wherein n is an integer selected from 0 to 6 and M is Mn, Fe or Cu, said cobalt ruthenate compounds being single phase materials as hereinbefore defined.

28. A thick film paste composition according to claim 27 wherein the cobalt ruthenate compounds are selected from the group consisting of:

$Co_{2.25}Ru_{0.75}O_4$, $Co_{2.0}Ru_{0.75}Mn_{0.25}O_4$, $Co_{2.0}Ru_{0.75}Fe_{0.25}O_4$, $Co_{2.0}Ru_{0.75}Cu_{0.25}O_4$, $Co_{1.75}Ru_{0.75}Cu_{0.5}O_4$ and $Co_{1.5}Ru_{0.75}Cu_{0.75}O_4$.

29. A thick film paste composition according to claim 25, wherein the glass is as recited in any of claims 5 to 9.

30. A thick film paste composition according to claim 25 wherein the organic vehicle is selected from among aliphatic alcohols or esters thereof, terpens, terpineol, solutions of polymethylacrylates of lower alcohols, solutions of ethyl cellulose in pine oil and the monobutyl ether of ethylene glycol monoacetate.

31. A thick film paste composition according to claim 25 wherein the aggregate weight of the active compound and glass constitutes between 60 to 90% by weight of the composition, and the weight of the vehicle is between 40% to 10.

* * * * *

UNITED STATES PATENT AND TRADEMARK OFFICE

CERTIFICATE OF CORRECTION

PATENT NO. : 6,066,271

DATED : May 23, 2000

INVENTOR(S) : Hormadaly

It is certified that error appears in the above-identified patent and that said Letters Patent is hereby corrected as shown below:

Col. 4, line 9, "compunds" should read --compounds--.

Col. 4, line 22, delete "(".

Col. 5, line 27, "temperataure" should read --temperature--.

Col. 6, line 49, delete "formula" (second occurrence).

Col. 10, line 13, "effected" should read --affected--.

Col. 10, line 18, "composite" should read --$\alpha_{composite}$--.

Col. 12, line 2, after "such" insert --as--.

Col. 12, line 21, delete "(".

Col. 15, line 31, after "resistances" insert --)--.

UNITED STATES PATENT AND TRADEMARK OFFICE

CERTIFICATE OF CORRECTION

PATENT NO. : 6,066,271

DATED : May 23, 2000

INVENTOR(S) : Hormadaly

It is certified that error appears in the above-identified patent and that said Letters Patent is hereby corrected as shown below:

Col. 17, line 25, after "reproducibility" insert --)--.

Col. 18, line 49, "referr" should read --refer--.

Col 20, line 39, "detail" should read --details--.

Col. 20, line 36, "illsutartion" should read --illustration--.

Col. 23, line 59, delete "lower than".

Signed and Sealed this

Tenth Day of April, 2001

*Attest:*

Nicholas P. Godici

NICHOLAS P. GODICI

*Attesting Officer*

*Acting Director of the United States Patent and Trademark Office*